US008888270B2

(12) United States Patent
Kachi

(10) Patent No.: US 8,888,270 B2
(45) Date of Patent: Nov. 18, 2014

(54) INKJET RECORDING APPARATUS AND IMAGE FORMING METHOD

(75) Inventor: Yasuhiko Kachi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 211 days.

(21) Appl. No.: 13/464,755

(22) Filed: May 4, 2012

(65) Prior Publication Data

US 2012/0281049 A1 Nov. 8, 2012

(30) Foreign Application Priority Data

May 6, 2011 (JP) ..... 2011-103660

(51) Int. Cl.
*B41J 2/01* (2006.01)
*B41J 11/00* (2006.01)

(52) U.S. Cl.
CPC ..... *B41J 11/002* (2013.01)
USPC ..... 347/102

(58) Field of Classification Search
CPC ..... B41J 11/002
USPC ..... 347/102
See application file for complete search history.

(56) References Cited

U.S. PATENT DOCUMENTS

| | | | | |
|---|---|---|---|---|
| 5,844,585 | A | 12/1998 | Kurashima et al. | |
| 6,457,823 | B1 * | 10/2002 | Cleary et al. | 347/102 |
| 6,739,716 | B2 * | 5/2004 | Richards | 347/102 |
| 7,152,969 | B2 * | 12/2006 | Hintermann | 347/102 |
| 7,232,212 | B2 * | 6/2007 | Iwase | 347/102 |
| 7,393,095 | B2 * | 7/2008 | Oshima et al. | 347/102 |
| 7,562,957 | B2 * | 7/2009 | Mills et al. | 347/15 |
| 7,600,867 | B2 * | 10/2009 | Mills et al. | 347/102 |
| 7,682,013 | B2 | 3/2010 | Hoshino | |
| 7,758,179 | B2 * | 7/2010 | Niekawa | 347/102 |
| 8,123,346 | B2 * | 2/2012 | Ohnishi et al. | 347/102 |

(Continued)

FOREIGN PATENT DOCUMENTS

| | | |
|---|---|---|
| JP | 2004-306617 A | 11/2004 |
| JP | 2006-289772 A | 10/2006 |

(Continued)

OTHER PUBLICATIONS

JPO Office Action Notification of Reasons for Refusal for Japanese patent application No. 2011-103660; dated Apr. 5, 2013 (partial english translation), reference No. 11F00278, Dispatch No. 227549.*

*Primary Examiner* — Laura Martin
*Assistant Examiner* — Jeremy Bishop
(74) *Attorney, Agent, or Firm* — Birch, Stewart, Kolasch & Birch, LLP

(57) ABSTRACT

An inkjet recording apparatus includes: an image forming device; a scanning device; a relative movement device which causes relative movement between the recording medium and the image forming device; a first active light beam irradiation device which radiates an active light beam onto the ink to provisionally cure the ink; a second active light beam irradiation device which radiates an active light beam having an irradiation light quantity for fully curing the ink; an ejection control device which controls ink ejection from the nozzle row, for each of a plurality of nozzle groups; and an irradiation control device which controls irradiation of the active light beam of the first active light beam irradiation device, with respect to each of a plurality of irradiation units, according to an irradiation light quantity of the active light beam of the first active light beam irradiation device.

10 Claims, 17 Drawing Sheets

(56) References Cited

U.S. PATENT DOCUMENTS

| | | | | |
|---|---|---|---|---|
| 8,177,350 | B2 * | 5/2012 | Mitsuzawa | 347/102 |
| 8,215,761 | B2 * | 7/2012 | Takezawa et al. | 347/102 |
| 8,382,274 | B2 * | 2/2013 | Mitsuzawa | 347/102 |
| 8,393,700 | B2 * | 3/2013 | Otsuka et al. | 347/9 |
| 8,480,195 | B2 * | 7/2013 | Fujisawa et al. | 347/9 |
| 8,529,009 | B2 * | 9/2013 | Onishi | 347/16 |
| 8,585,198 | B2 * | 11/2013 | Onishi et al. | 347/102 |
| 8,602,519 | B2 * | 12/2013 | Kagose et al. | 347/20 |
| 8,602,548 | B2 * | 12/2013 | Miyabayashi | 347/102 |
| 2007/0109382 | A1 * | 5/2007 | Lafleche et al. | 347/102 |
| 2010/0289860 | A1 | 11/2010 | Takezawa et al. | |
| 2011/0235069 | A1 | 9/2011 | Otsuka et al. | |
| 2012/0069109 | A1 * | 3/2012 | Anderson et al. | 347/102 |
| 2012/0120168 | A1 * | 5/2012 | Kachi et al. | 347/102 |
| 2012/0287184 | A1 * | 11/2012 | Shimada | 347/9 |
| 2012/0287190 | A1 * | 11/2012 | Shimada | 347/12 |

FOREIGN PATENT DOCUMENTS

| | | | | |
|---|---|---|---|---|
| JP | 2009-51095 | A | 3/2009 | |
| JP | 2010-83059 | A | 4/2010 | |
| JP | 2010-149516 | A | 7/2010 | |
| JP | 2010-17308 | A | 8/2010 | |
| JP | 2011-83917 | A | 4/2011 | |
| WO | WO 2009148074 | A1 * | 12/2009 | B41J 11/00 |

* cited by examiner

INKJET RECORDING APPARATUS AND IMAGE FORMING METHOD

BACKGROUND OF THE INVENTION

1. Field of the Invention

The present invention relates to an inkjet recording apparatus and an image forming method, and more particularly, to an image forming technology using ultraviolet-curable ink.

2. Description of the Related Art

Inkjet recording apparatuses having a structure which forms a desired image on a recording medium by ejecting color ink from an inkjet head have been known as a general image forming apparatus. In recent years, non-permeable (low-permeability) media such as a resin film have been used, in addition to media having permeability such as paper, and apparatuses which cure ink deposited on a medium by radiating ultraviolet light as active light have been proposed.

In an inkjet recording apparatus which uses ultraviolet-curable ink, a light source for radiating ultraviolet light is mounted on a carriage on which an inkjet head is installed, the ultraviolet light source is scanned (moved) so as to follow the inkjet head, and ultraviolet light is radiated onto ink droplets immediately after landing on a medium, thereby preventing positional displacement or dots interference of the ink droplets.

Furthermore, in order to improve the glossiness of a color image, a method is known in which a layer of clear ink (transparent ink) is formed on a color image. Various modifications are made in order that the cured state of the clear ink affects the glossiness of the image.

Japanese Patent Application Publication No. 2006-289722 discloses an inkjet recording apparatus which is composed so as to eject colored ink from a colored ink recording head, radiate light onto the colored ink by a light irradiation apparatus, and then eject transparent ink from a transparent ink recording head and radiate light from the light irradiation apparatus after a prescribed time period has elapsed. In the inkjet recording apparatus, by keeping a uniform time from the deposition of the transparent ink onto the recording medium until the irradiation of light, a uniform dot diameter is achieved regardless of the direction of movement of the transparent ink recording head, thereby preventing non-uniformity in glossiness.

Japanese Patent Application Publication No. 2010-149516 discloses an inkjet printer which is composed so as to print a color image by radiating ultraviolet light while ejecting color ink onto a recording medium, in a serial type image formation method, and to pull back the recording medium to the printing start position after printing of the color image, eject clear ink onto the recording medium on which the color image has been printed while the ultraviolet lamps are extinguished, and to then radiate ultraviolet light onto the clear ink that has been ejected onto the recording medium. This inkjet printer resolves a phenomenon of loss of glossiness by preventing the clear ink deposited on the recording medium from curing before the ink becomes flat.

Japanese Patent Application Publication No. 2009-51095 discloses an inkjet recording apparatus which is composed so as to enable variation in the glossiness of an image, by altering the intensity of ultraviolet light which is used to cure ink that has been deposited on the recording medium.

However, the inkjet recording apparatus disclosed in Japanese Patent Application Publication No. 2006-289722 discloses adjusting the time until ultraviolet light is radiated after deposition of clear ink onto a recording medium, but does not disclose the specific conditions of irradiation of ultraviolet light.

Furthermore, Japanese Patent Application Publication No. 2010-149516 and Japanese Patent Application Publication No. 2009-51095 disclose changing the glossiness of an image by altering the irradiation conditions of ultraviolet light, but do not disclose the specific conditions of irradiation of ultraviolet light.

SUMMARY OF THE INVENTION

The present invention has been contrived in view of these circumstances, an object thereof being to provide an inkjet recording apparatus and an image forming method whereby an image having a desired glossiness can be formed by controlling irradiation of an active light beam.

In order to achieve an aforementioned object, one aspect of the invention is directed to an inkjet recording apparatus comprising: an image forming device including a nozzle row having a plurality of nozzles for ejecting ink onto a recording medium, the ink being to be curable by irradiation of an active light beam, the nozzle row being divided into a plurality of nozzle groups; a scanning device which causes the image forming device to move in a scanning direction perpendicular to a nozzle arrangement direction in which the plurality of nozzles of the nozzle row are arranged; a relative movement device which causes relative movement between the recording medium and the image forming device in the nozzle arrangement direction; a first active light beam irradiation device which is provided to a downstream side of the image forming device in terms of the scanning direction, is divided into a plurality of irradiation units corresponding to the plurality of nozzle groups, and radiates an active light beam onto the ink on the recording medium so as to provisionally cure the ink while moving in the scanning direction together with the image forming device; a second active light beam irradiation device which is provided to a downstream side of the image forming device in terms of a direction of the relative movement, and radiates an active light beam having an irradiation light quantity for fully curing the ink deposited on the recording medium in such a manner that the ink on the recording medium is fully cured; an ejection control device which controls ink ejection from the nozzle row, for each of the plurality of nozzle groups; and an irradiation control device which controls irradiation of the active light beam of the first active light beam irradiation device, with respect to each of the plurality of irradiation units, according to an irradiation light quantity of the active light beam of the first active light beam irradiation device which is set with respect to each of the plurality of irradiation units.

Another aspect of the invention is directed to an image forming method comprising the steps of causing an image forming device having a nozzle row in which a plurality of nozzles for ejecting ink towards a recording medium are arranged in a nozzle arrangement direction and which is divided into a plurality of nozzle groups, to eject the ink from each of the plurality of nozzle groups of the nozzle row, while causing the image forming device to move in a scanning direction perpendicular to the nozzle arrangement direction of the nozzle row, the ink being curable by irradiation of an active light beam; causing relative movement between the recording medium and the image forming device in the nozzle arrangement direction; radiating an active light beam onto the ink from a first active light beam irradiation device which is provided to a downstream side of the image forming device in the scanning direction and is divided into a plurality of irradiation units corresponding to the plurality of nozzle groups in such a manner that the ink on the recording medium is provisionally cured, while moving the first active light beam irradiation device in the scanning direction together with the image forming device; and radiating an active light beam having an irradiation light quantity for fully curing the ink deposited on the recording medium from a second active light beam irradiation device which is provided to a downstream side of the image forming device in a direction of the relative movement in such a manner that the ink on the recording medium is fully cured, wherein in the step of provisionally curing the ink on the recording medium, radiation of the active light beam from the first active light beam irradiation device is controlled, for each of the plurality of irradiation units, according to an irradiation light quantity of the active light beam of the first active light beam irradiation device which is set for each of the plurality of irradiation units.

According to the present invention, since a nozzle row in which a plurality of nozzles for ejecting ink are arranged is divided in the relative movement direction of the recording medium and the image forming device (nozzle row), the first active light beam irradiation device which provisionally cures the ink which has been ejected from the nozzle row and deposited onto the recording medium by irradiating an active light beam onto the ink is divided in accordance with the nozzle row, and the irradiated light quantity of the active light beam is set for each irradiation unit which is a divided unit of the first active light beam irradiation device, then the ink which has been ejected from a particular nozzle group is provisionally cured by the active light beam irradiated from an irradiation unit following the nozzle group and a provisionally cured state of the ink corresponding to the irradiated light quantity of the irradiation unit is obtained. Consequently, it is possible to control the provisionally cured state of the ink with respect to each irradiation unit (nozzle group), and the glossiness reproduction range of the image can be expanded in accordance with the provisionally cured state of the ink.

BRIEF DESCRIPTION OF THE DRAWINGS

A preferred embodiment of this invention as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

First embodiment

Firstly, an inkjet recording apparatus and an image forming method relating to a first embodiment of the present invention will be described in detail.

General Composition of Inkjet Recording Apparatus

Figure 1:
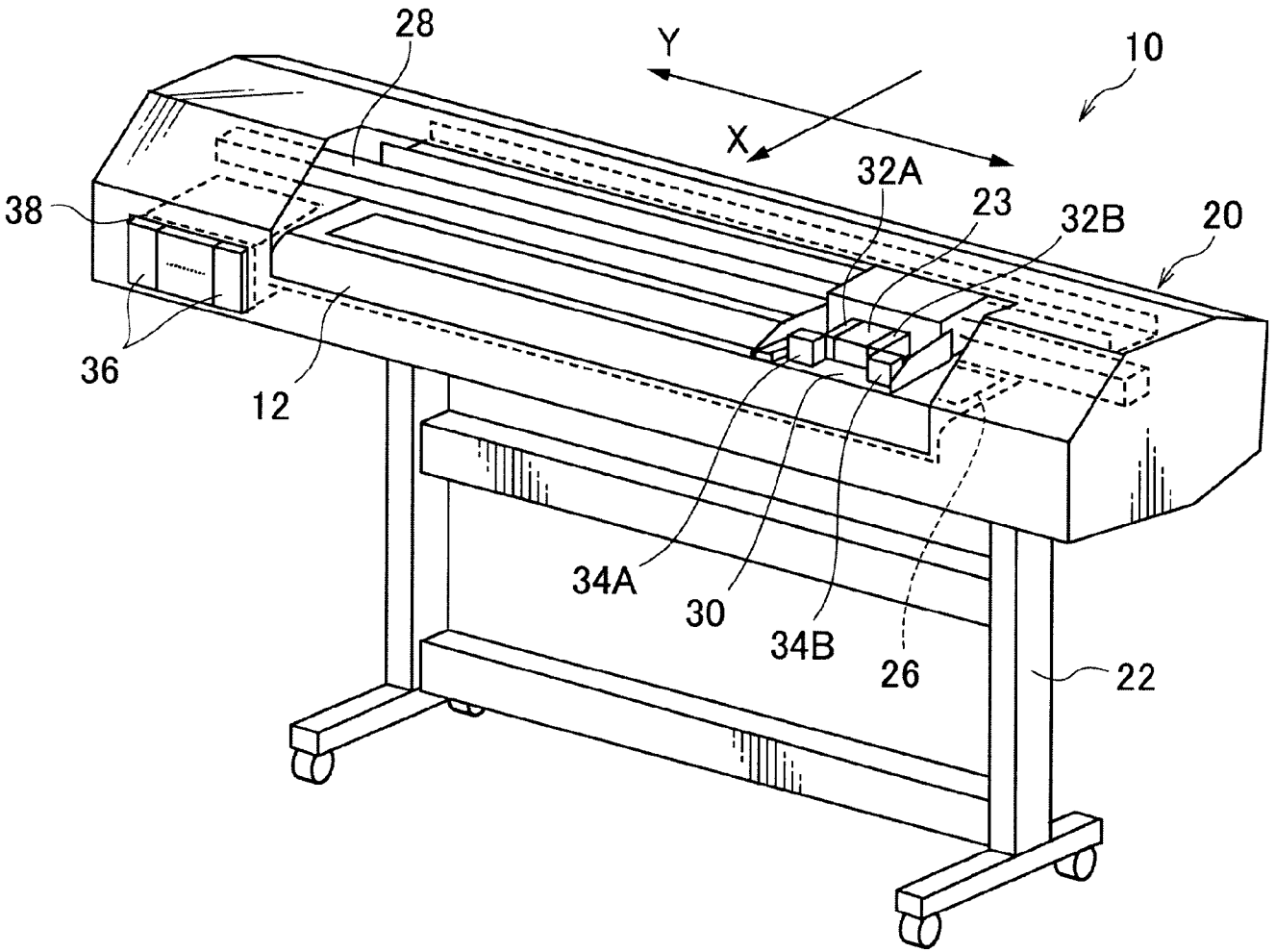
FIG. 1 is an external oblique perspective drawing of an inkjet recording apparatus relating to a first embodiment of the present invention.

FIG. 1 is an external oblique perspective drawing of an inkjet recording apparatus relating to a first embodiment of the present invention. This inkjet recording apparatus 10 is a wide-format printer which forms a color image on a recording medium 12 by using ultraviolet-curable ink (UV-curable ink).

A wide-format printer is an apparatus which is suitable for recording a wide image formation range, such as for large posters or commercial wall advertisements, or the like. Here, a printer for dealing with a medium having a size of A3 or greater (e.g. slight greater than A3 (297 mm×420 mm), for example, 329 mm×483 mm) is called "wide-format".

The inkjet recording apparatus 10 includes an apparatus main body 20 and a stand 22 which supports the apparatus main body 20. The apparatus main body 20 includes an image forming unit 23 including a drop-on-demand type of inkjet head (not shown in FIG. 1 but shown by numeral 24 in FIG. 3) which ejects ink toward a recording medium (medium) 12, a platen 26 which supports the recording medium 12, and a guide mechanism 28 and a carriage 30 which form a head movement means (scanning device (moving device)).

The guide mechanism 28 is disposed so as to extend above the platen 26, following a scanning direction (Y direction) which is parallel to the medium supporting surface of the platen 26 and which is perpendicular to the conveyance direction (X direction) of the recording medium 12. The carriage 30 is supported so as to be able to perform reciprocal movement in the Y direction along a guide mechanism 28.

The image forming unit 23 is mounted on the carriage 30, and provisional curing light sources (pinning light sources) 32A, 32B, and main curing light sources (curing light sources) 34A, 34B which radiate ultraviolet light onto the ink on the recording medium 12 are also mounted on the carriage 30.

The provisional curing light sources 32A, 32B are light sources which irradiate ultraviolet light, which is an active light beam, onto ink that has been ejected from the image forming unit 23 and deposited on the recording medium 12, while performing a scanning (moving) action in the Y direction together with the image forming unit 23, from a timing at which the provisional curing light sources 32A, 32B arrive above the ink and while the provisional curing light sources 32A, 32B pass over the ink.

The ink onto which ultraviolet has been irradiated from the provisional curing light sources 32A, 32B is provisionally cured to an extent which avoids landing interference while allowing expansion of the dots (allowing the dots to spread sufficiently).

The main curing light sources 34A, 34B are light sources which perform a follow-up exposure after the ultraviolet light has been irradiated from the provisional curing light sources 32A, 32B onto the ink on the recording medium 12, and finally irradiates ultraviolet light for full curing (main curing) of the ink.

The image forming unit 23, the provisional curing light sources 32A, 32B and the main curing light sources 34A, 34B disposed on the carriage 30 move in unison with (together with) the carriage 30 along the guide mechanism 28.

The reciprocal direction of movement of the carriage 30 (Y direction) may be called the "main scanning direction" or "scanning direction of the image forming unit 23" and the conveyance direction of the recording medium 12 (X direction) may be called the "sub-scanning direction" or "direction of relative movement of the image forming unit 23 and the recording medium 12".

Various media may be used for the recording medium 12, without any restrictions on the material, whether the medium is permeable or non-permeable; therefore, paper, unwoven cloth, vinyl chloride, compound chemical fibers, polyethylene, polyester, tarpaulin, or the like, may be used for the recording medium 12.

Figure 2:
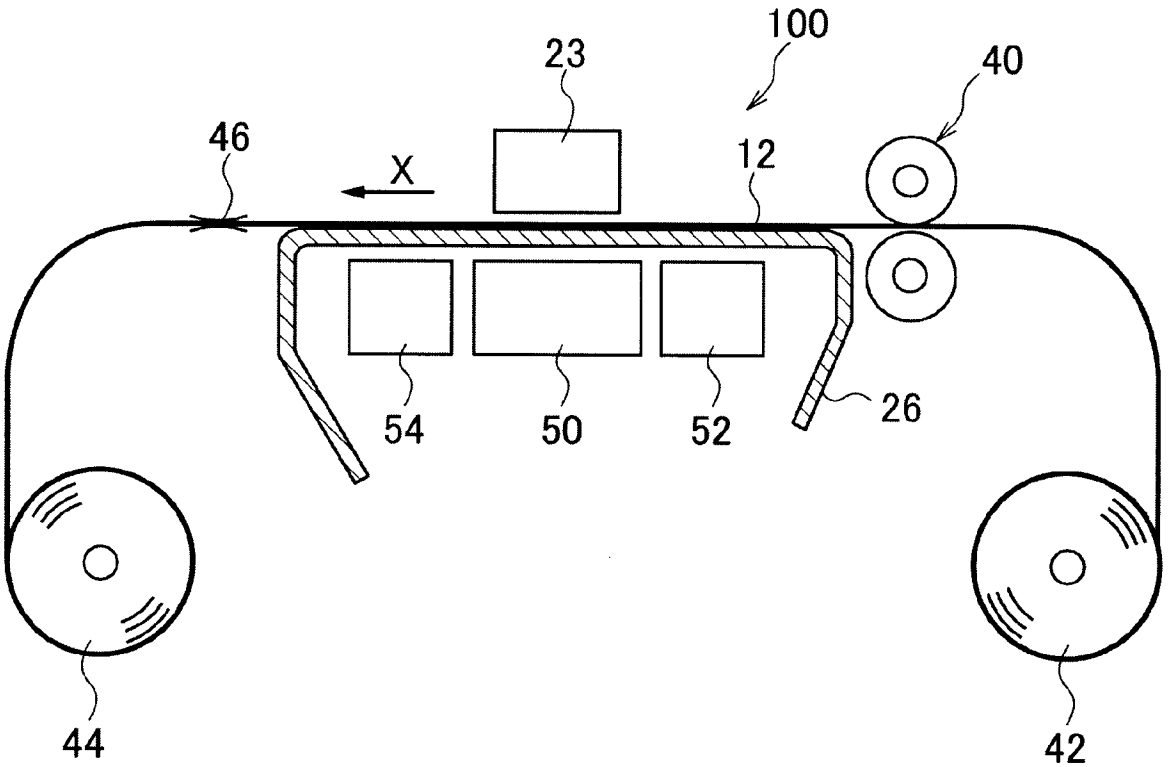
FIG. 2 is an illustrative diagram which shows a schematic drawing of a paper conveyance path in the inkjet recording apparatus shown in FIG. 1.

The recording medium 12 is supplied in a rolled state (see FIG. 2) from the rear surface of the apparatus, and after printing, the medium is rolled onto a take-up roller on the front side of the apparatus (not shown in FIG. 1 but shown by reference numeral 44 in FIG. 2). Ink droplets are ejected from the image forming unit 23 onto the recording medium 12 which has been conveyed onto the platen 26, and ultraviolet light is irradiated from the provisional curing light sources 32A, 32B and the main curing light sources 34A, 34B onto ink droplets which have been deposited onto the recording medium 12.

In FIG. 1, the installation section 38 of ink cartridges 36 is provided in the left-side front face of the apparatus main body 20 when the apparatus is viewed from the front. The ink cartridges 36 are replaceable ink supply sources (ink tanks) which each store an ultraviolet-curable ink.

The ink cartridges 36 are provided so as to correspond to respective inks which are used in the inkjet recording apparatus 10 of the present example. The ink cartridges 36 of the respective colors are respectively connected, by ink supply channels (not illustrated) which are formed independently, to the inkjet heads corresponding to the respective colors of the image forming unit 23.

If the remaining amount of ink in the ink cartridges 36 has become low, then a notification to this effect is issued. An ink cartridge 36 in which the remaining amount of ink has become low can be removed from the apparatus main body 20 and replaced with a new ink cartridge 36.

Although not shown in the drawings, a maintenance unit for the inkjet heads of the image forming unit 23 is provided on the right-hand side of the apparatus main body 20 as viewed from the front side. This maintenance unit includes a cap for keeping the inkjet heads moist when not printing, and a wiping member (blade, web, etc.) for cleaning the nozzle surface (ink ejection surface) of each inkjet head. The cap which caps the nozzle surface of each inkjet head is provided with an ink receptacle for receiving ink droplets ejected from the nozzles for the purpose of maintenance.

Description of Recording Medium Conveyance Path

FIG. 2 is an illustrative diagram showing a schematic view of the recording medium conveyance path in the inkjet recording apparatus 10. As shown in this figure, the platen 26 is formed in an inverted gutter shape and the upper surface thereof is a supporting surface (medium supporting surface) for a recording medium 12.

A pair of nip rollers 40 which forms a recording medium conveyance device for intermittently conveying the recording medium 12 is provided on the upstream side of the platen 26 in the conveyance direction (X direction) of the recording medium 12, in the vicinity of the platen 26. These nip rollers 40 move the recording medium 12 in the recording medium conveyance direction over the platen 26.

The recording medium 12 which is output from a supply side roll (pay-out supply roll) 42 that constitutes a roll-to-roll type recording medium conveyance device is conveyed intermittently in the conveyance direction of the recording medium 12 by the pair of nip rollers 40 which are provided in an inlet entrance of the image forming region (on the upstream side of the platen 26 in terms of the recording medium conveyance direction).

When the recording medium 12 has arrived at the image forming region directly below the image forming unit 23, printing is carried out by the image forming unit 23, and the recording medium is then wound up onto a take-up roll 44 after printing. A guide 46 for the recording medium 12 is provided on the downstream side of the image forming region in the recording medium conveyance direction.

A temperature adjustment unit 50 for adjusting the temperature of the recording medium 12 during image forming is provided on the rear surface side (an opposite surface side to the surface supporting the recording medium 12) of the platen 26 at a position opposing the inkjet head 24, in the image forming region.

When the recording medium 12 is adjusted to a prescribed temperature during the image forming, the viscosity, surface tension, and other properties, of the ink droplets having landed onto the recording medium 12, assume prescribed values and it is possible to obtain a desired dot diameter. According to requirements, it is possible to provide a heat pre-adjustment unit 52 on the upstream side of the temperature adjustment unit 50 or to provide a heat after-adjustment unit 54 on the downstream side of the temperature adjustment unit 50.

Figure 3:
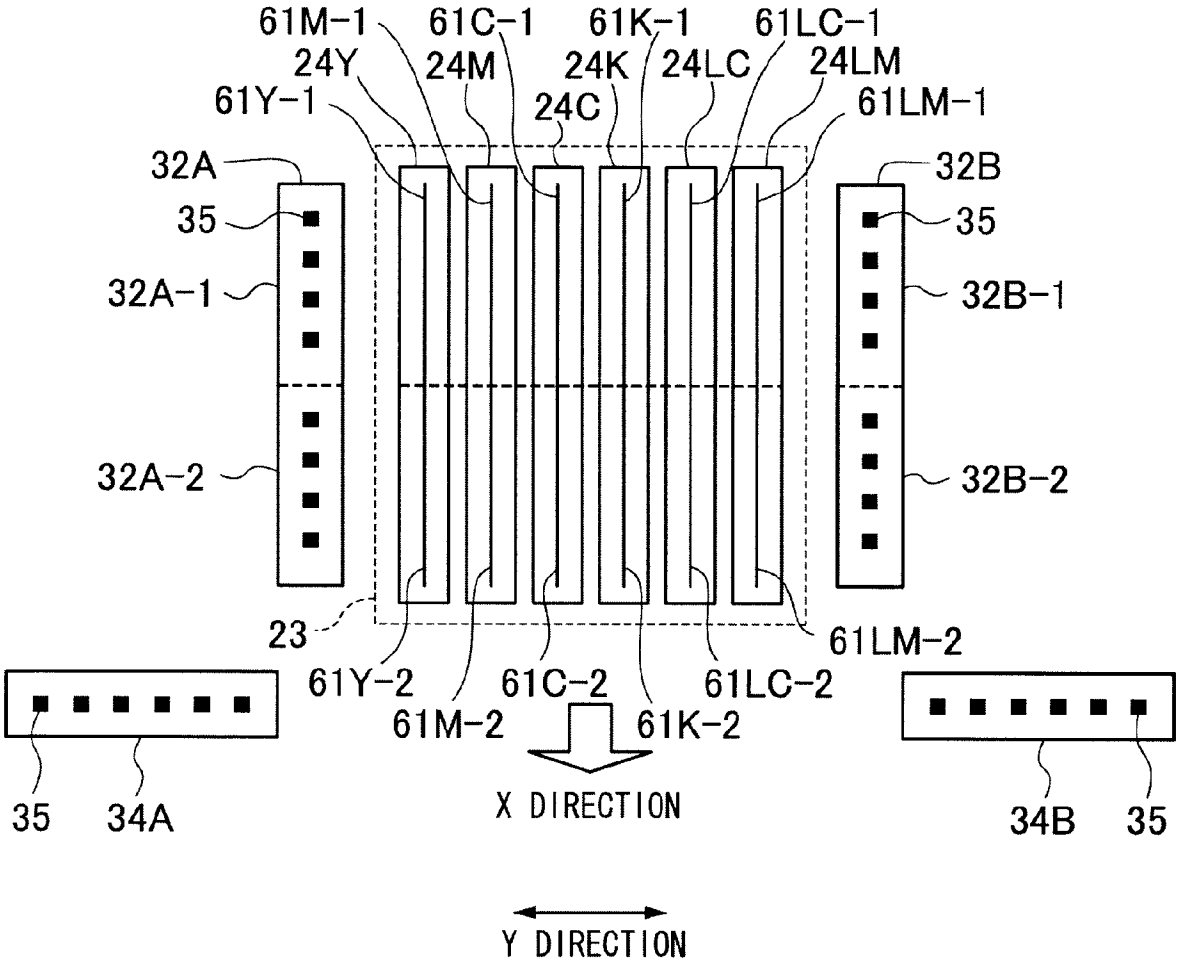
FIG. 3 is a plan view perspective diagram showing a composition of arrangement of the inkjet head and the ultraviolet irradiation unit shown in FIG. 1.

Description of Image Forming Unit, Provisional Curing Light Source and Main Curing Light Source FIG. 3 is a plan view perspective diagram showing an example of an arrangement of the image forming unit 23, the provisional curing light sources 32A, 32B, and the main curing light sources 34A, 34B which are arranged on the carriage 30 (see FIG. 1).

The image forming unit 23 shown in FIG. 3 includes inkjet heads 24Y, 24M, 24C, 24K, 24LC, 24LM based on an inkjet method. The inkjet heads 24Y, 24M, 24C, 24K, 24LC, 24LM correspond to inks of the respective colors of yellow (Y), magenta (M), cyan (C), black (K), light cyan (LC) and light magenta (LM).

The inkjet heads 24Y, 24M, 24C, 24K, 24LC, 24LM are respectively provided with nozzle rows 61Y, 61M, 61C, 61K, 61LC, 61LM in which a plurality of nozzles for ejecting ink are arranged.

In FIG. 3, the nozzle rows are indicated by solid lines, and individual nozzles are not depicted. In the description given below, the inkjet heads 24Y, 24M, 24C, 24K, 24LC, 24LM may be referred to generally as an "inkjet head 24", and the nozzle rows 61Y, 61M, 61C, 61K, 61LC, 61LM may be referred to generally as a "nozzle row 61".

As shown in FIG. 3, the inkjet heads 24Y, 24M, 24C, 24K, 24LC, 24LM (nozzle rows 61Y, 61M, 61C, 61K, 61LC, 61LM) are arranged at equidistant intervals in the main scanning direction.

Furthermore, the nozzle rows 61Y, 61M, 61C, 61K, 61LC, 61LM which are provided respectively on the inkjet heads 24Y, 24M, 24C, 24K, 24LC, 24LM are divided into two groups in terms of the conveyance direction of the recording medium 12.

In FIG. 3, the reference numerals 61Y-1, 61M-1, 61C-1, 61K-1, 61LC-1, 61LM-1 are assigned to the nozzle groups (divided units) on the upstream side of the conveyance direction of the recording medium 12, and the reference numerals 61Y-2, 61M-2, 61C-2, 61K-2, 61LC-2, 61LM-2 are assigned to the nozzle groups on the downstream side of the conveyance direction of the recording medium 12.

The upstream-side nozzle groups 61Y-1, 61M-1, 61C-1, 61K-1, 61LC-1, 61LM-1 and the downstream-side nozzle groups 61Y-2, 61M-2, 61C-2, 61K-2, 61LC-2, 61LM-2 illustrated in FIG. 3 have the same length, and the length is half the total length of the nozzle rows 61Y, 61M, 61C, 61K, 61LC, 61LM.

Moreover, in the inkjet heads 24Y, 24M, 24C, 24K, 24LC, 24LM shown in FIG. 3, the ejection of ink from the upstream-side nozzle groups 61Y-1, 61M-1, 61C-1, 61K-1, 61LC-1, 61LM-1 of the nozzle rows 61Y, 61M, 61C, 61K, 61LC, 61LM and the ejection of ink from the downstream-side nozzle groups 61Y-2, 61M-2, 61C-2, 61K-2, 61LC-2, 61LM-2 of the nozzle rows 61Y, 61M, 61C, 61K, 61LC, 61LM can be controlled independently of each other.

As shown in FIG. 3, a provisional curing light source 32A is disposed to the outside of the inkjet head 24Y in one end portion of the image forming unit 23 (the left end portion in FIG. 3), and a provisional curing light source 32B is disposed to the outside of the inkjet head 24LM in the other end portion of the image forming unit 23 (the right end portion in FIG. 3).

The provisional curing light sources 32A, 32B are divided into two parts in the conveyance direction of the recording medium 12, so as to correspond to the division of the nozzle rows 61. Reference numerals 32A-1 and 32B-1 are assigned to the irradiation units (divided units) on the upstream side in terms of the conveyance direction of the recording medium 12, and reference numerals 32A-2 and 32B-2 are assigned to the irradiation units on the downstream side in terms of the conveyance direction of the recording medium 12.

The irradiation region of the upstream-side irradiation unit 32A-1 of the provisional curing light source 32A and the upstream-side irradiation unit 32B-1 of the provisional curing light source 32B corresponds to the ink ejection region (possible image forming region) of the upstream-side nozzle groups 61Y-1, 61M-1, 61C-1, 61K-1, 61LC-1, 61LM-1 of the nozzle rows 61Y, 61M, 61C, 61K, 61LC, 61LM.

Furthermore, the irradiation region of the downstream-side irradiation unit 32A-2 of the provisional curing light source 32A and the downstream-side irradiation unit 32B-2 of the provisional curing light source 32B corresponds to the ink ejection region (possible image forming region) of the downstream-side nozzle groups 61Y-2, 61M-2, 61C-2, 61K-2, 61LC-2, 61LM-2 of the nozzle rows 61Y, 61M, 61C, 61K, 61LC, 61LM.

The provisional curing light sources 32A, 32B are composed in such a manner that the quantity of irradiated light can be controlled with respect to each irradiation unit, so that the ink curing conditions can be varied with respect to each of nozzle groups of the nozzle rows 61.

The provisional curing light sources 32A, 32B are provided with a plurality of ultraviolet LED elements (UV-LED elements) 35. In the mode shown in FIG. 3, the provisional curing light sources 32A, 32B each include eight ultraviolet LED elements 35 arranged in one row in the conveyance direction of the recording medium 12.

Furthermore, in the provisional curing light sources 32A, 32B, the four ultraviolet LED elements 35 arranged on the upstream side in terms of the conveyance direction of the recording medium 12 belong to the upstream-side irradiation units 32A-1, 32B-1 of the provisional curing light sources 32A, 32B, and the four ultraviolet LED elements 35 arranged on the downstream side in terms of the conveyance direction of the recording medium 12 belong to the downstream-side irradiation units 32A-2, 32B-2 of the provisional curing light sources 32A, 32B.

By adjusting the quantity of irradiated light of the ultraviolet LED elements 35 independently with respect to each of the irradiation units 32A-1, 32A-2, 32B-1, 32B-2 of the provisional curing light sources 32A, 32B, it is possible to vary the quantity of irradiated ultraviolet light with respect to each of the upstream-side irradiation units 32A-1, 32B-1 and the downstream-side irradiation units 32A-2, 32B-2.

The main curing light sources 34A, 34B are provided with a plurality of ultraviolet LED elements 35, similarly to the provisional curing light sources 32A, 32B. In the mode shown in FIG. 3, the ultraviolet LED elements 35 of the main curing light sources 34A, 34B are arranged in one row in the scanning direction of the inkjet heads 24.

The arrangement and number of the ultraviolet LED elements 35 is not limited to the mode shown in FIG. 3. For example, it is also possible to adopt a mode in which ultraviolet LED elements 35 are arranged in a two-dimensional configuration following the scanning direction of the inkjet heads 24 and the conveyance direction of the recording medium 12.

The types of ink color (number of colors) and the combination of colors are not limited to the present embodiment. For example, it is also possible to adopt a mode where the LC and LM nozzle rows are omitted, a mode where a clear ink (CL) nozzle row and/or a white ink (W) nozzle row are added, a mode where a nozzle row for metal ink is added, a mode where a nozzle row for metal ink is provided instead of the W nozzle row, or a mode where a nozzle row which ejects ink of a special color is added. Moreover, the arrangement sequence of the nozzle rows of the respective colors are not limited in particular.

In FIG. 3, an image forming unit 23 equipped with inkjet heads 24Y, 24M, 24C, 24K, 24LC, 24LM for the respective colors is shown, but it is also possible to adopt a mode in which nozzle rows 61Y, 61M, 61C, 61K, 61LC, 61LM for the respective colors are provided in one inkjet head 24.

For example, it is possible to adopt a mode in which a plurality of nozzle rows 61Y, 61M, 61C, 61K, 61LC, 61LM are arranged at equidistant intervals in the main scanning direction, in one inkjet head 24.

In the inkjet head 24 according to the present embodiment, the arrangement pitch of the nozzles which make up each nozzle row 61 (nozzle pitch) is 254 μm (100 dpi), the number of nozzles which constitute one nozzle row 61 is 256 nozzles, and the total length $L_w$ of each nozzle row 61 (the total length of the nozzle row) is approximately 65 mm (254 μm×255=64.8 mm). Furthermore, the ejection frequency is 15 kHz, and ejection droplet volumes of three types, 10 pl, 20 pl, 30 pl, can be ejected selectively, by changing the drive waveform.

The ink ejection method of the inkjet head 24 employs a method which propels ink droplets by deformation of a piezoelectric element (piezo actuator) (piezo jet method). For the ejection energy generating element, apart from a mode using an electrostatic actuator (electrostatic actuator method), it is also possible to employ a mode which generates air bubbles by heating ink using a heater (heating element) and which propels ink droplets by the pressure of these air bubbles (thermal jet method).

However, since the ultraviolet-curable ink generally has a high viscosity compared to solvent ink, it is desirable to employ a piezo jet method which has a relatively large ejection force when using an ultraviolet-curable ink.

Explanation of Image Formation Mode

The inkjet recording apparatus 10 shown in this embodiment employs multi-pass image formation control, and the print resolution can be varied by changing the number of printing passes. For example, three image formation modes are used: high-productivity mode, standard mode, high-quality mode, and the print resolution is different in the respective modes. The image formation mode is selected in accordance with the print objective and application.

In the high-productivity mode, printing is carried out at a resolution of 600 dpi (main scanning direction)×400 dpi (sub-scanning direction). In high-productivity mode, a resolution of 600 dpi is achieved by two passes (two scanning actions) in the main scanning direction.

In the first scan (the outward movement of the carriage 30), dots are formed at a resolution of 300 dpi. In the second scan (the return movement), dots are formed so as to be interpolated between the dots formed by the first scan (outward movement), and a resolution of 600 dpi is obtained in the main scanning direction.

On the other hand, the nozzle pitch is 100 dpi in the sub-scanning direction, and dots are formed at a resolution of 100 dpi in the sub-scanning direction by one main scanning action (one pass). Consequently, a resolution of 400 dpi is achieved by carrying out interpolated printing by four-pass printing (four scans).

In the standard mode, printing is carried out at a resolution of 600 dpi×800 dpi, and this 600 dpi×800 dpi resolution is achieved by means of two pass printing in the main scanning direction and eight pass printing in the sub-scanning direction.

In the high-quality mode, printing is carried out at a resolution of 1200×1200 dpi, and this 1200 dpi×1200 dpi resolution is achieved by means of four passes in the main scanning direction and twelve passes in the sub-scanning direction. The main scanning speed of the carriage 30 in the high-productivity mode is 1270 mm/sec.

Ink Supply System

Figure 4:
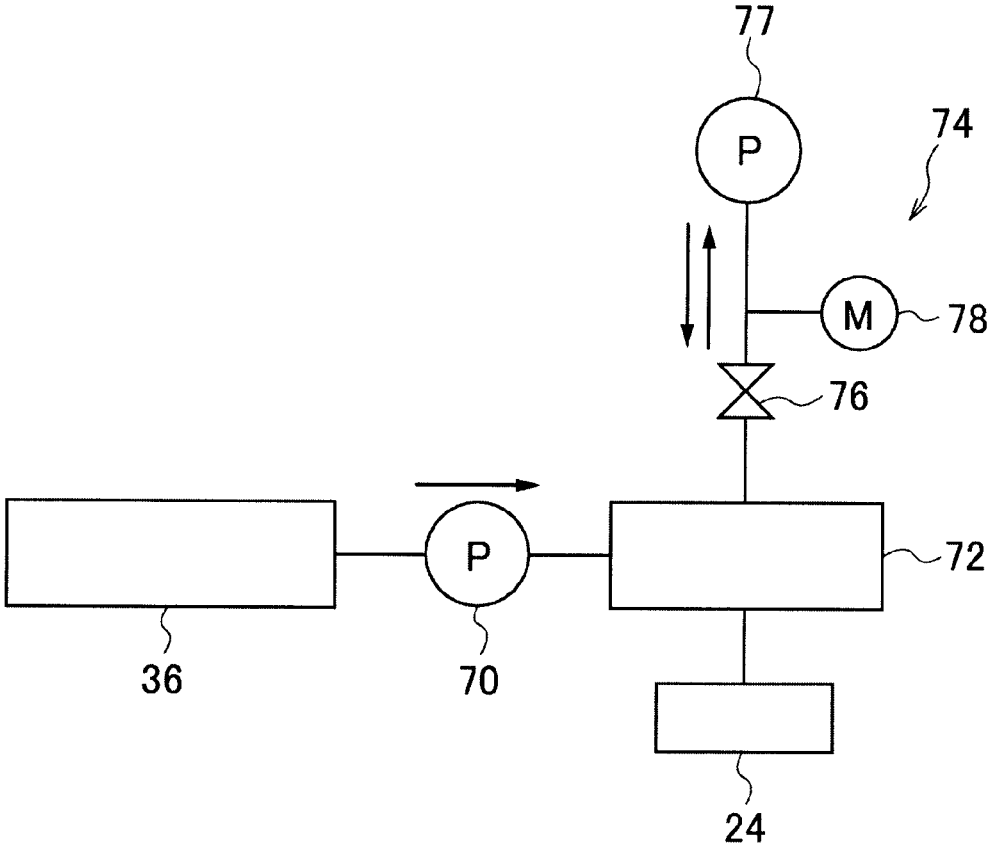
FIG. 4 is a block diagram showing an approximate configuration of the ink supply system of the inkjet head shown in FIG. 1.

FIG. 4 is a block diagram showing a configuration of an ink supply system of the inkjet recording apparatus 10. As shown in FIG. 4, ink accommodated in an ink cartridge 36 is suctioned by the supply pump 70, and is conveyed to the inkjet head 24 via a sub-tank 72.

A pressure adjustment unit 74 for adjusting the pressure of the ink in the sub-tank 72 is provided with the sub-tank 72.

The pressure adjustment unit 74 includes a pressure reducing pump 77 which is connected to the sub tank 72 via a valve 76, and a pressure gauge 78 which is provided between the valve 76 and the pressure reducing pump 77.

During the normal printing, the pressure reducing pump 77 operates in a direction which suctions ink inside the sub-tank 72, and keeps a negative pressure inside the sub-tank 72 and a negative pressure inside the inkjet head 24. On the other hand, during maintenance of the inkjet head 24, the pressure reducing pump 77 is operated in a direction which increases the pressure of the ink inside the sub tank 72, thereby forcibly raising the internal pressure of the sub-tank 72 and the internal pressure of the inkjet head 24, and ink inside the inkjet head 24 is expelled via nozzles. The ink which has been forcibly expelled from the inkjet head 24 is accommodated in the ink receptacle of the cap (not shown) described above.

Description of Inkjet Recording Apparatus Control System

Figure 5:
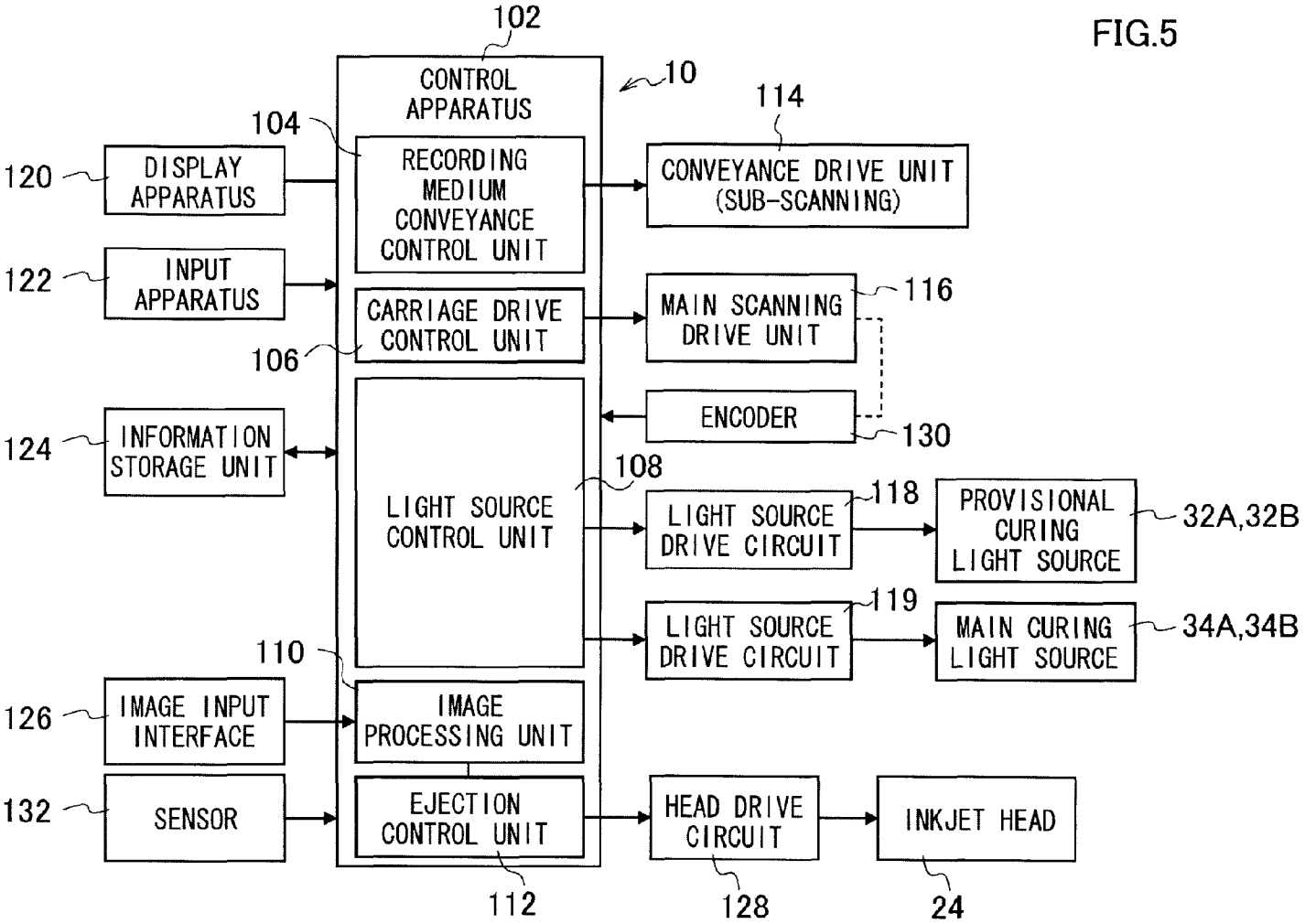
FIG. 5 is a block diagram showing an approximate configuration of the control system of the inkjet head shown in FIG. 1.

FIG. 5 is a block diagram showing the schematic composition of a control system of an inkjet recording apparatus 10 relating to an embodiment of the present invention. As shown in FIG. 5, in the inkjet recording apparatus 10, a control unit (a control apparatus) 102 is provided as a control device which performs overall control of the entire apparatus.

For this control unit 102, it is possible to use, for example, a computer equipped with a central processing unit (CPU), or the like. The control unit 102 functions as a control apparatus for controlling the whole of the inkjet recording apparatus 10 in accordance with a prescribed program, as well as functioning as a calculation apparatus for performing various calculations.

The control unit 102 includes a recording medium conveyance control unit 104, a carriage drive control unit 106, a light source control unit 108, an image processing unit 110, and an ejection control unit 112. These respective units are achieved by a hardware circuit or software, or a combination of these.

The recording medium conveyance control unit 104 controls the conveyance drive unit 114 for conveying the recording medium 12 (see FIG. 1). The conveyance drive unit 114 includes a drive motor which drives the nip rollers 40 shown in FIG. 2, and a drive circuit thereof.

The recording medium 12 which is conveyed onto the platen 26 (see FIG. 1) is conveyed intermittently in swath width units in the sub-scanning direction, in accordance with a reciprocal scanning action (printing pass action) in the main scanning direction performed by the inkjet head 24.

The carriage drive control unit 106 shown in FIG. 5 controls the main scanning drive unit 116 for moving the carriage 30 (see FIG. 1) in the main scanning direction. The main scanning drive unit 116 includes a drive motor which is connected to a movement mechanism of the carriage 30, and a control circuit thereof.

The light source control unit 108 is a control device which controls light emission of the ultraviolet LED elements 35 (see FIG. 3) of the provisional curing light sources 32A and 32B via a light source drive circuit 118, as well as controlling light emission of the main curing light sources 34A, 34B via a light source drive circuit 119.

Light emission of the ultraviolet LED elements 35 can be controlled by the light source control unit 108 by means of, for instance, a current value control which alters the current value supplied to the ultraviolet LED elements 35, a pulse width modulation control which alters the duty of the voltage (pulse voltage) applied to the ultraviolet LED elements 35, an on/off control of the ultraviolet LED elements 35, or the like.

For the light-emitting elements of the provisional curing light sources 32A, 32B and the main curing light sources 34A, 34B, apart from the ultraviolet LED elements 35 (see FIG. 3), it is also possible to employ a UV lamp such as a metal halide lamp, or the like.

An input apparatus 122 such as an operating panel, and a display apparatus 120, are connected to the control unit 102. The input apparatus 122 is a device by which external operating signals are manually input to the control unit 102, and may employ various formats, such as a keyboard, a mouse, a touch panel, or operating buttons, or the like.

The display apparatus 120 may employ various formats, such as a liquid crystal display, an organic EL display, a CRT, or the like. An operator is able to select an image formation mode, input print conditions, and input and edit additional conditions, and the like, by operating the input apparatus 122, and is able to confirm the input details and various information such as search results, via the display on the display apparatus 120.

Furthermore, an information storage unit 124 which stores various information and an image input interface 126 for acquiring image data for printing are provided in the inkjet recording apparatus 10. It is possible to employ a serial interface or a parallel interface for the image input interface. In this part, it is also possible to install a buffer memory (not illustrated) for achieving high-speed communications.

The image data input via the image input interface 126 is converted into data for printing (dot data) by the image processing unit 110. In general, the dot data is generated by subjecting the multiple-tone image data to color conversion processing and half-tone processing.

The color conversion processing is processing for converting image data represented by an sRGB system, or the like (for example, 8-bit RGB image data of respective colors of RGB) into color data of the respective colors of ink used by the inkjet recording apparatus 100.

A half-toning process is processing for converting the color data of the respective colors generated by the color conversion processing into dot data of respective colors by error diffusion, a threshold value matrix, or the like. The means for the half-toning process may employ commonly known methods of various kinds, such as an error diffusion method, a dithering method, a threshold value matrix method, a density pattern method, and the like.

The half-toning process generally converts graduated image data having three or more tone values into graduated image data having fewer tone values than the original number of tones. In the simplest example, the image data is converted into dot image data having 2 values (dot on/dot off), but in a half-toning process, it is also possible to perform quantization in multiple values which correspond to different types of dot size (for example, three types of dot: a large dot, a medium dot and a small dot).

The binary or multiple-value image data (dot data) obtained in this way is used for driving (on) or not driving (off) the each nozzle, and in the case of multiple-value data, is used as ink ejection data (ejection droplet control data) for controlling the droplet volume (dot size).

The ejection control unit 112 generates an ejection control signal for the head drive circuit 128 on the basis of dot data generated in the image processing unit 110. Furthermore, the ejection control unit 112 includes a drive waveform generation unit, which is not illustrated.

The drive waveform generation unit is a device which generates a drive voltage signal for driving an ejection energy generation element (in the present embodiment, a piezo element) which correspond to each of the nozzles of the inkjet head 24. The waveform data of the drive voltage signal is stored previously in the information storage unit 124 and waveform data to be used is output as and when required.

The signal (drive waveform) output from the drive waveform generation unit is supplied to the head drive circuit 128. The signal output from the drive waveform generation unit may be digital waveform data or an analog voltage signal.

An ink is ejected from a corresponding nozzle, by applying a common drive voltage signal to each of the ejection energy generation devices of the inkjet head 24 via the head drive circuit 128 and switching the switching elements (not illustrated) which are connected to the individual electrodes of the energy generating elements on and off in accordance with the ejection timings of the respective nozzles.

Programs to be executed by the CPU of the control unit 102 and various data required for control purposes are stored in the information storage unit 124. The information storage unit 124 stores the resolution settings information, the number of passes (number of scanning repetitions), and control information for the provisional curing light sources 32A, 32B, and the main curing light sources 34A, 34B, and the like, on the basis of the image formation modes.

An encoder 130 is attached to the drive motor of the main scanning drive unit 116 and the drive motor of the conveyance drive unit 114, and outputs a pulse signal corresponding to the amount of rotation and the speed of rotation of each drive motor, this pulse signal being supplied to the control unit 102. The position of the carriage 30 and the position of the recording medium 12 are ascertained on the basis of the pulse signal output from the encoder 130.

The sensor 132 includes sensors, such as a position detection sensor, a temperature sensor, a pressure sensor, and the like, which are provided in the respective units of the apparatus. Examples are, for instance, a sensor which is installed on the carriage 30 for ascertaining the width and position of the recording medium 12, a temperature sensor which determines the temperature of the platen 26 (see FIG. 1), and the like.

Although not shown in the drawings, the inkjet recording apparatus 10 includes a pump control unit which controls the operation of pumps, such as the supply pump 70 and the pressurization and depressurization pump 77 shown in FIG. 4, and the like, and a valve control unit which controls the operation of valves such as the valve 76.

The pump control unit sends command signals which indicate the on/off switching, rotational speed and rotational direction of the supply pump 70 and the pressurization and depressurization pump 77, on the basis of the control signals sent from the control unit 102.

Further, the valve control unit sends command signals which indicate on/off switching of the valve 76, on the basis of the control signals sent from the control unit 102.

Image Formation Method

Figure 6:
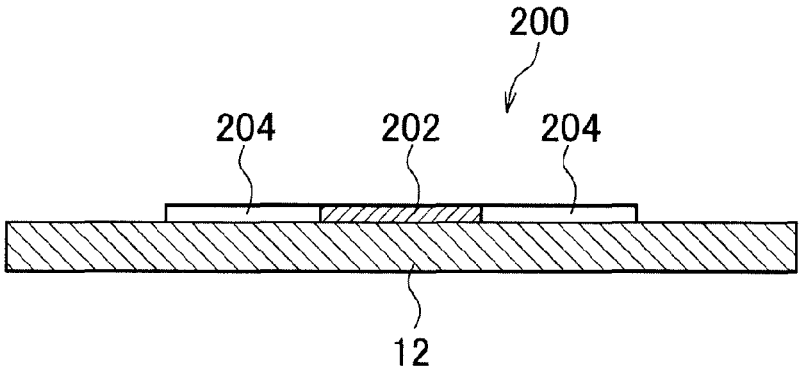
FIG. 6 is an illustrative diagram showing a schematic view of an image formed by an inkjet recording apparatus relating to a first embodiment of the present invention.

Next, an image formation method employed in the inkjet recording apparatus 10 of the present embodiment is explained. FIG. 6 is an explanation drawing schematically illustrating an image 200 formed by the inkjet recording apparatus 10 of the present embodiment.

The inkjet recording apparatus 10 shown in this embodiment varies the quantity of light irradiated from the provisional curing light sources 32A, 32B, with respect to each of the irradiation units 32A-1, 32A-2, 32B-1, 32B-2, and hence the cured state of the ink is varied with respect to each of the irradiation regions corresponding to the irradiation units 32A-1, 32A-2, 32B-1, 32B-2.

The image 200 shown in FIG. 6 includes a matt texture 202 in substantially a central portion, and a gloss texture 204 in a peripheral portion. The colored inks ejected from the upstream-side nozzle groups 61Y-1, 61M-1, 61C-1, 61K-1, 61LC-1, 61LM-1 of the nozzle rows 61Y, 61M, 61C, 61K, 61LC, 61LM onto the portion where the matt texture 202 is to be formed receive irradiation of ultraviolet light of a high quantity from the upstream-side irradiation units 32A-1 and 32B-1 of the provisional curing light sources 32A, 32B.

The ink onto which ultraviolet light of a high quantity has been irradiated is cured to a gel state which impedes dot expansion, while preventing landing interference. In other words, when ultraviolet light of a high quantity is radiated onto ink immediately after landing on the recording medium 12, the ink (dots) are provisionally cured before spreading fully.

Furthermore, the inks ejected from the downstream-side nozzle groups 61Y-2, 61M-2, 61C-2, 61K-2, 61LC-2, 61LM-2 of the nozzle rows 61Y, 61M, 61C, 61K, 61LC, 61LM onto the portion where the gloss texture 204 is to be formed receive irradiation of ultraviolet light of a low quantity from the downstream-side irradiation units 32A-2 and 32B-2 of the provisional curing light sources 32A, 32B.

The ink onto which ultraviolet light of a low quantity has been irradiated is cured to a gel state which allows dot expansion, while preventing landing interference. In other words, when ultraviolet light of a low quantity is irradiated onto ink immediately after landing on the recording medium 12, the ink (dots) are provisionally cured so as to spread adequately.

Figure 7A:
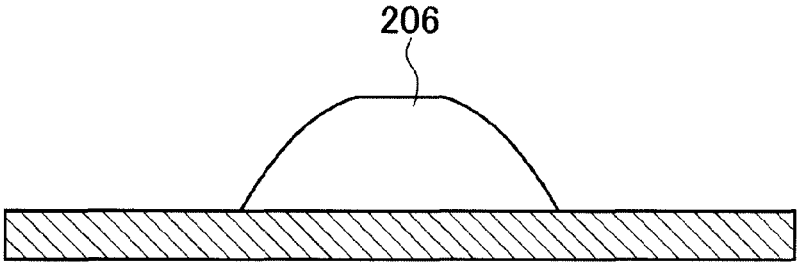
FIGS. 7A and 7B are diagrams for describing variation in the expansion of an ink dot with change in the quantity of irradiated ultraviolet light.

FIG. 7A is an illustrative diagram showing a schematic drawing of ink (an ink dot) 206 which is cured by irradiating ultraviolet light of a high quantity. The ink 206 shown in FIG. 7A is cured in a state where the dot has not expanded sufficiently and the ink has a high pile height.

The image formed by the ink 206 in this state (the matt texture 202 in FIG. 6) is a texture of low glossiness (high surface roughness) which is known as a "matt" texture.

Figure 7B:
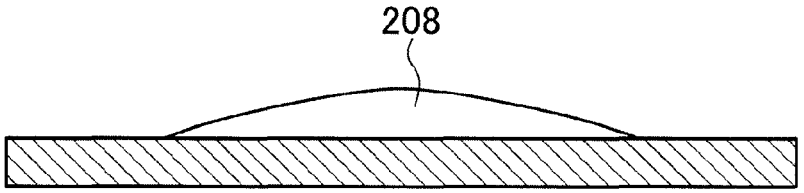

FIG. 7B is an illustrative diagram showing a schematic drawing of ink (an ink dot) 208 which is cured by being irradiating ultraviolet light of a low quantity. The ink 208 shown in FIG. 7B is cured in a state where the dot has expanded sufficiently and has a reduced pile height.

The image formed by the ink 208 in this state (the gloss texture 204 in FIG. 6) is a texture of high glossiness (fine surface roughness) which is known as a "gloss" texture.

As shown in FIG. 3, in the inkjet recording apparatus 10 shown in the present embodiment, the nozzle rows 61 and the provisional curing light sources 32A, 32B are divided in terms of the conveyance direction of the recording medium 12, and the upstream-side irradiation units form an image with a matt finish whereas the downstream-side irradiation units form an image with a gloss finish.

The image forming method described above includes Step 1 to Step 3 below.

Step 1

When the region where a matt texture 202 is to be formed on the recording medium 12 arrives directly below the upstream-side nozzle groups 61Y-1, 61M-1, 61C-1, 61K-1, 61LC-1, 61LM-1 of the inkjet heads 24Y, 24M, 24C, 24K, 24LC, 24LM (nozzle rows 61Y, 61M, 61C, 61K, 61LC, 61LM), then color inks are ejected from the upstream-side nozzle groups 61Y-1, 61M-1, 61C-1, 61K-1, 61LC-1, 61LM-1, and then ultraviolet light of a high quantity is irradiated onto the color inks immediately after landing on the recording medium 12, from the upstream-side irradiation units 32A-1, 32B-1 of the provisional curing light sources 32A, 32B, so that a matt texture 202 is formed.

Step 2

Furthermore, when the region where a gloss texture 204 is to be formed on the recording medium 12 arrives directly below the downstream-side nozzle groups 61Y-2, 61M-2, 61C-2, 61K-2, 61LC-2, 61LM-2 of the inkjet heads 24Y, 24M, 24C, 24K, 24LC, 24LM (nozzle rows 61Y, 61M, 61C, 61K, 61LC, 61LM), then color inks are ejected from the downstream-side nozzle groups 61Y-2, 61M-2, 61C-2, 61K-2, 61LC-2, 61LM-2, and then ultraviolet light of a low quantity is irradiated onto the color inks immediately after landing on the recording medium 12, from the downstream-side irradiation units 32A-2, 32B-2 of the provisional curing light sources 32A, 32B, so that a gloss texture 204 is formed.

Step 3

After the recording medium 12 has left the image forming region of the image forming unit 23, ultraviolet light of an even higher quantity than the downstream-side irradiation units 32A-2, 32B-2 of the provisional curing light sources 32A, 32B is irradiated from the main curing light sources 34A, 34B which are provided to the downstream side in terms of the conveyance direction of the recording medium 12, thereby stopping the spreading of the dots and performing a full curing process for curing the film of ink.

In this way, by means of the steps from Step 1 to Step 3, an image 200 having a combination of a matt texture 202 and a gloss texture 204 in one image is formed by a single-pass method, without returning the recording medium 12 in the reverse direction.

Here, the low quantity of light in the provisional curing process is not less than 2 $mJ/cm^2$ and not more than 4 $mJ/cm^2$, and the high quantity of light in the provisional curing process is not less than 8 $mJ/cm^2$ and not more than 10 $mJ/cm^2$.

In other words, desirably, the ratio of the high quantity of light with respect to the low quantity of light in the provisional curing is not less than two times and not more than five times.

Moreover, the quantity of irradiated light in the main curing process is not less than 150 $mJ/cm^2$ and not more than 300 $mJ/cm^2$, and hence is not less than 15 times and not more than 150 times greater than the high quantity of light in the provisional curing process. The quantity of irradiated ultraviolet light is varied appropriately in accordance with the composition of the ink used.

According to the inkjet recording apparatus which is composed as described above, it is possible to form a matt texture 202 and a gloss texture 204 in the same image 200, by means of a single pass method which performs image formation while conveying the recording medium 12 in one direction, without returning the recording medium 12 in the reverse direction, and therefore the gloss and matt reproduction range is increased.

Furthermore, since the recording medium 12 is not conveyed in reverse, it is possible to shorten the image formation time, even when forming an image which combines a matt texture and a gloss texture, and furthermore, no positional displacement occurs between the matt texture 202 and the gloss texture 204.

Second Embodiment

Next, an inkjet recording apparatus and an image forming method relating to a second embodiment of the present invention will be described. In the following description, parts which are the same as or similar to the first embodiment which is described previously are labeled with the same reference numerals and further explanation thereof is omitted here.

Composition of the Printing Unit

Figure 8:
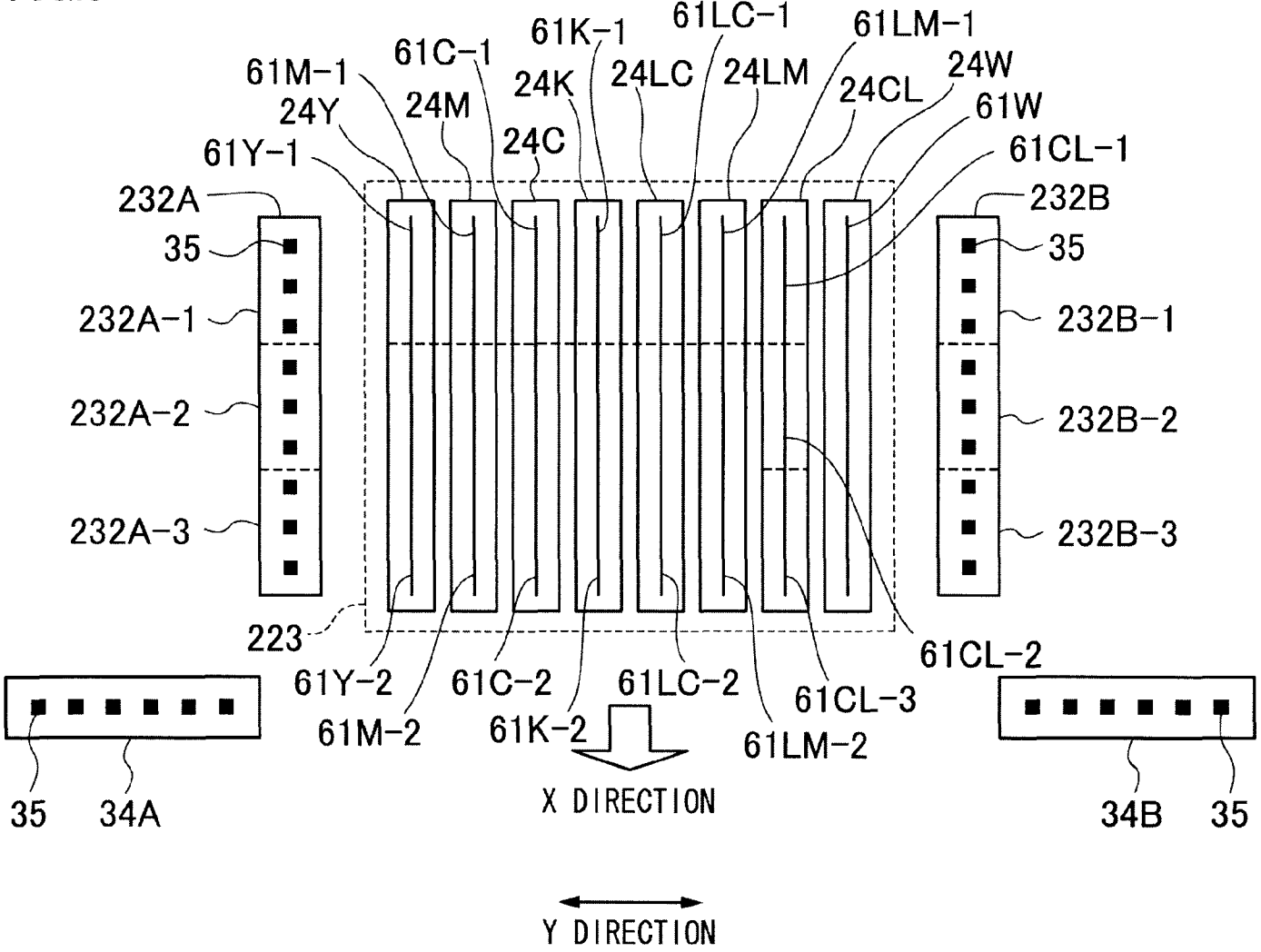
FIG. 8 is a plan view perspective diagram showing an arrangement structure of inkjet heads and ultraviolet light irradiation units in an inkjet recording apparatus relating to a second embodiment of the present invention.

FIG. 8 is a plan view perspective diagram showing an approximate composition of a printing unit 223 of an inkjet recording apparatus according to this embodiment. The printing unit 223 shown in FIG. 8 includes an inkjet head 24CL corresponding to clear ink (CL) in addition to the image forming unit 23 which is shown in FIG. 3.

As shown in FIG. 8, an inkjet head 24W corresponding to white ink (W) may be added.

The inkjet head 24CL is arranged to the outside of the inkjet head 24LM corresponding to light magenta (LM). Furthermore, in a mode where an inkjet head 24W is added, the inkjet head 24W is arranged further to the outside of the inkjet head 24CL.

The nozzle rows 61Y, 61M, 61C, 61K, 61LC, 61LM of the inkjet heads 24Y, 24M, 24C, 24K, 24LC, 24LM are divided into two parts in the conveyance direction of the recording medium 12, namely, into upstream-side nozzle groups 61Y-1, 61M-1, 61C-1, 61K-1, 61LC-1, 61LM-1 having a length of one third of the total length of the nozzle rows 61Y, 61M, 61C, 61K, 61LC, 61LM from the end on the upstream side of the conveyance direction and downstream-side nozzle groups 61Y-2, 61M-2, 61C-2, 61K-2, 61LC-2, 61LM-2 having a length of two thirds of the total length of the nozzle rows 61Y, 61M, 61C, 61K, 61LC, 61LM from the end on the downstream side of the conveyance direction.

Furthermore, the inkjet head 24CL is divided into three parts in the conveyance direction of the recording medium 12. In other words, the nozzle row 61CL which is provided in the inkjet head 24CL includes an upstream-side nozzle group 61CL-1 having a length of one third of the total length of the nozzle row 61CL, from the end on the upstream side in the conveyance direction, an intermediate nozzle group 61CL-2 having a length of one third of the total length of the nozzle row 61CL, including a central portion in the conveyance direction, and a downstream-side nozzle group 61CL-3 having a length of one third of the total length of the nozzle row 61CL from the downstream-side end in the conveyance direction.

The upstream-side nozzle groups 61Y-1, 61M-1, 61C-1, 61K-1, 61LC-1, 61LM-1 of the nozzle rows 61Y, 61M, 61C, 61K, 61LC, 61LM which correspond to the color inks function as nozzle rows for forming a color image.

Furthermore, the intermediate nozzle group 61CL-2 and the downstream-side nozzle group 61CL-3, of the nozzle row 61CL corresponding to the clear ink, function as nozzle rows for forming a clear ink layer which is layered onto the color image.

Furthermore, the intermediate nozzle group 61CL-2 of the nozzle row 61CL corresponding to clear ink forms a matt texture by clear ink and the downstream-side nozzle group 61CL-3 form a gloss texture.

The nozzle row 61W corresponding to the white ink functions as a nozzle row for forming an under layer (white layer) of the color image. For example, an under layer comprising white ink is formed when using a transparent or semi-transparent medium.

The provisional curing light sources 232A, 232B are divided into three parts in the conveyance direction of the recording medium 12 so as to correspond to the clear ink nozzle row 61CL, and the length in the conveyance direction of the irradiation region of each irradiation unit is the same (one third of the length in the conveyance direction of the irradiation regions of the provisional curing light sources 232A, 232B).

More specifically, the provisional curing light sources 232A, 232B has upstream-side nozzle groups 232A-1, 232B-1, intermediate nozzle groups 232A-2, 232B-2 and downstream-side nozzle groups 232A-3, 232B-3.

The quantity of irradiated ultraviolet light of the provisional curing light sources 232A, 232B is controlled with respective to each irradiation unit, and the upstream-side nozzle groups 232A-1, 232B-1 function as ultraviolet light sources which irradiate ultraviolet light of a low quantity onto an image formed by color inks.

Furthermore, the intermediate nozzle groups 232A-2, 232B-2 function as ultraviolet light sources for irradiating ultraviolet light of a high quantity onto the clear ink, when forming a matt texture with the clear ink, and the downstream-side nozzle groups 232A-3, 232B-3 function as ultraviolet light sources for irradiating ultraviolet light of a low quantity onto the clear ink, when forming a gloss texture with the clear ink.

Description of Image Forming Method

Figure 9:
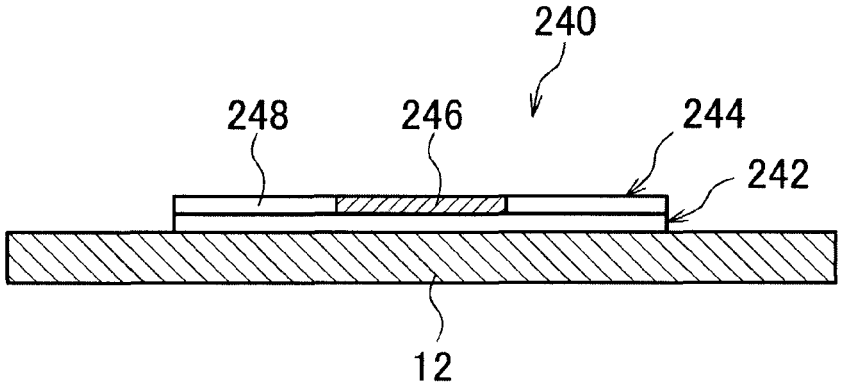
FIG. 9 is an illustrative diagram showing a schematic view of an image formed by the inkjet recording apparatus relating to the second embodiment of the present invention.

FIG. 9 is an illustrative diagram showing a schematic view of a color image formed by using the printing unit 223 shown in FIG. 8. The color image 240 shown in this figure has a structure in which a clear ink layer 244 is layered on top of a color image layer 242, and furthermore, the clear ink layer 244 includes a matt texture 246 and a gloss texture 248.

The color image 240 shown in FIG. 9 is formed through Step 11 to Step 14 described below.

Step 11

Of the nozzle rows 61Y, 61M, 61C, 61K, 61LC, 61LM provided in the inkjet heads 24Y, 24M, 24C, 24K, 24LC, 24LM respectively, inks of respective colors are ejected from the upstream-side nozzle groups 61Y-1, 61M-1, 61C-1, 61K-1, 61LC-1, 61LM-1.

The color inks deposited onto the recording medium 12 receive irradiation of ultraviolet light of a low quantity (for example, not less than 2 mJ/cm$^2$ and not more than 4 mJ/cm$^2$) from the upstream-side nozzle groups 232A-1, 232B-1 of the provisional curing light sources 232A, 232B, from immediately after landing on the medium, thereby curing the inks to a gel state which avoids landing interference.

Step 12

Next, clear ink is ejected onto the matt texture application area from the intermediate nozzle group 61CL-2 of the nozzle row 61CL provided in the inkjet head 24CL. The clear ink for matt texture which has been deposited onto the recording medium 12 receives irradiation of ultraviolet light of a high quantity (for example, not less than 8 mJ/cm$^2$ and not more than 10 mJ/cm$^2$) from the intermediate nozzle groups 232A-2, 232B-2 of the provisional curing light sources 232A, 232B, from immediately after landing on the medium, thereby curing the clear ink before it spreads fully.

Step 13

Clear ink is ejected onto the gloss texture application area from the downstream-side nozzle group 61CL-3 of the nozzle row 61CL provided in the inkjet head 24CL. The clear ink for gloss texture which has been deposited onto the recording medium 12 receives irradiation of ultraviolet light of a low quantity (for example, a low quantity of not less than 2 mJ/cm$^2$ and not more than 4 mJ/cm$^2$) from the downstream-side nozzle groups 232A-3, 232B-3 of the provisional curing light sources 232A, 232B, from immediately after landing on the medium, and hence is cured in a sufficiently spread state (in a state of reduced pile height).

When forming a high-gloss texture, the downstream-side nozzle groups 232A-3 and 232B-3 of the provisional curing light sources 232A, 232B are switched off and ultraviolet light is not irradiated onto the clear ink for high-gloss texture which has been deposited onto the recording medium 12.

Step 14

After the clear ink ejected from the downstream-side nozzle group 61CL-3 of the nozzle row 61CL has spread sufficiently, ultraviolet light of a high quantity (for example, not less than 150 mJ/cm$^2$ and not more than 300 mJ/cm$^2$) is irradiated thereon from the main curing light sources 34A, 34B, which are disposed on the downstream side of the printing unit 223 in terms of the conveyance direction of the recording medium 12, thereby fully curing the color image layer 242 and the clear ink layer 244.

By Step 11 to Step 14 described above, a color image 240 having the expanded gloss reproduction range shown in FIG. 9 is formed.

According to the inkjet recording apparatus and the image forming method having the composition described above, a clear ink layer 244 is formed on top of the color image layer 242, and by forming a matt texture 246 and a gloss texture 248 on the clear ink layer 244, the glossiness of the color image 240 can be controlled.

Modification Examples

Figure 10:
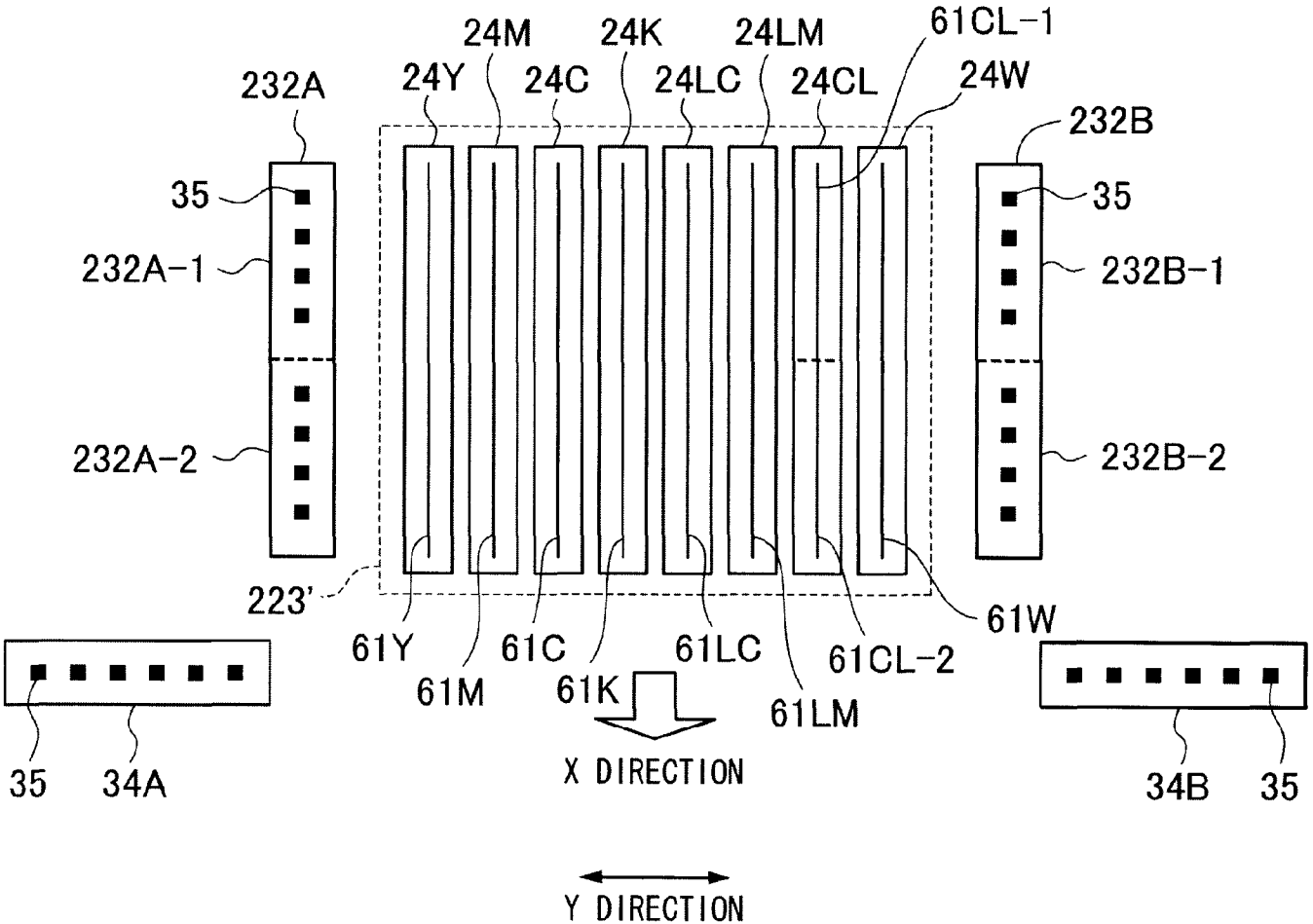
FIG. 10 is a plan view perspective diagram showing an arrangement structure of inkjet heads and ultraviolet light irradiation units in an inkjet recording apparatus relating to a modification of the second embodiment of the present invention.

Next, a modification example of the inkjet recording apparatus relating to the second embodiment will be described. FIG. 10 is a plan view perspective diagram showing an approximate composition of a printing unit 223' relating to the present modification example.

In the printing unit 223' shown in FIG. 10, the nozzle rows 61Y, 61M, 61C, 61K, 61LC, 61LM provided in the inkjet heads 24Y, 24M, 24C, 24K, 24LC, 24LM corresponding to the color inks are not divided in the conveyance direction of the recording medium 12.

On the other hand, the nozzle row 61CL provided in the inkjet head 24CL corresponding to the clear ink is divided into two parts in the conveyance direction. In the inkjet head 24CL, ink ejection is controlled independently (individually) in the upstream-side nozzle group 61CL-1 and the downstream-side nozzle group 61CL-2.

The provisional curing light sources 232A, 232B are divided into two parts in the conveyance direction of the recording medium 12, so as to correspond to the nozzle row 61CL of the inkjet head 24CL, and the quantity of irradiated ultraviolet light can be controlled independently (individually) in the upstream-side nozzle groups 232A-1, 232B-1 and the downstream-side nozzle groups 232A-1, 232B-1.

The printing unit 223' shown in FIG. 10 is able to form a color image 240 shown in FIG. 9 by applying Step 12' and Step 13' which are described below, instead of Step 12 and Step 13 described above.

Step 12'

The recording medium 12 on which the color image layer 242 has been formed is returned to the ejection start position of the inkjet head 24CL corresponding to clear ink, and is then conveyed in the conveyance direction of the recording medium 12 again.

The clear ink ejected from the upstream-side nozzle group 61CL-1 of the nozzle row 61CL corresponding to the clear ink receives irradiation of ultraviolet light of a high quantity (for example, not less than 8 mJ/cm$^2$ and not more than 10 mJ/cm$^2$) from the upstream-side nozzle groups 232A-1, 232B-1 of the provisional curing light sources 232A, 232B from immediately after landing on the recording medium 12, and is cured before spreading sufficiently.

Step 13'

The clear ink ejected from the downstream-side nozzle group 61CL-2 of the nozzle row 61CL corresponding to the clear ink receives irradiation of ultraviolet light of a low quantity (for example, not less than 2 mJ/cm$^2$ and not more than 4 mJ/cm$^2$) from the downstream-side nozzle groups 232A-2, 232B-2 of the provisional curing light sources 232A, 232B from immediately after landing on the recording medium 12, and is cured before spreading fully.

As described above, by means of Step 11, Step 12', Step 13' and Step 14, it is possible to form a color image 240 having an enlarged glossiness reproduction range as shown in FIG. 9.

According to this modification example, since the nozzle rows 61Y, 61M, 61C, 61K, 61LC, 61LM corresponding to the color inks are not divided, then it is possible to increase the ejection frequency as well as enlarging, by three times, the region in which an image can be formed by one scanning (moving) action of the printing unit 223', compared to the mode shown in FIG. 8.

Reference Example

This reference example describes a general image forming method in an inkjet recording apparatus equipped with a serial type inkjet head.

Figure 11:
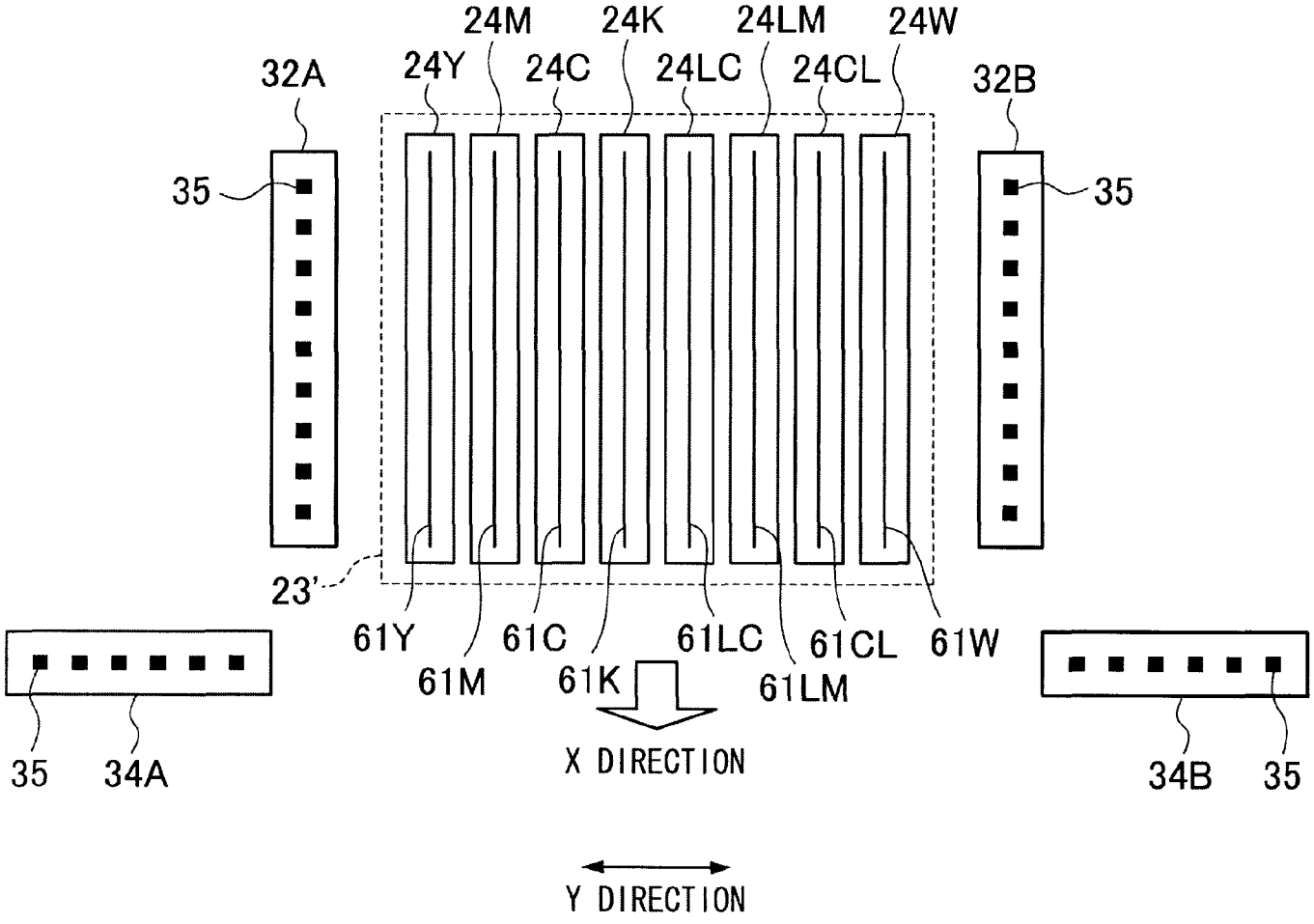
FIG. 11 is a plan view perspective diagram showing an arrangement structure of inkjet heads and ultraviolet light irradiation units for forming a one-layer color image.

FIG. 11 is a plan view perspective diagram showing an approximate composition of an image forming unit 23' relating to the present reference example. In the image forming unit 23' shown in FIG. 11, the nozzle row 61 and the provisional curing light sources 32A, 32B are not divided in the conveyance direction of the recording medium 12.

More specifically, a color image is formed by ejecting inks of respective colors from nozzle rows 61Y, 61M, 61C, 61K, 61LC, 61LM provided in the inkjet heads 24Y, 24M, 24C, 24K, 24LC, 24LM corresponding to color inks.

Moreover, the color inks deposited on the recording medium 12 receive irradiation of ultraviolet light of a low quantity (for example, not less than 2 mJ/cm$^2$ and not more than 4 mJ/cm$^2$) from the provisional curing light sources 32A, 32B, thereby curing the inks to a gel state which can avoid landing interference.

Thereupon, sufficient time is allowed until main curing, thereby promoting the permeation of the ink into the recording medium and the spreading of the dots (reduction of pile height), improvement of glossiness, and improvement in the adhesion of the color inks to the recording medium 12.

After the dots have spread sufficiently, ultraviolet light of a high quantity (for example, not less than 150 mJ/cm$^2$ and not more than 300 mJ/cm$^2$) is irradiated from the main curing light sources 34A, 34B, which are disposed on the downstream side of the image forming unit 23' in terms of the conveyance direction of the recording medium 12, thereby fully curing the dots.

By means of this main curing process, it is possible to achieve improved glossiness and adhesion of the color inks to the recording medium 12, and hard film properties of the ink.

Figure 12:
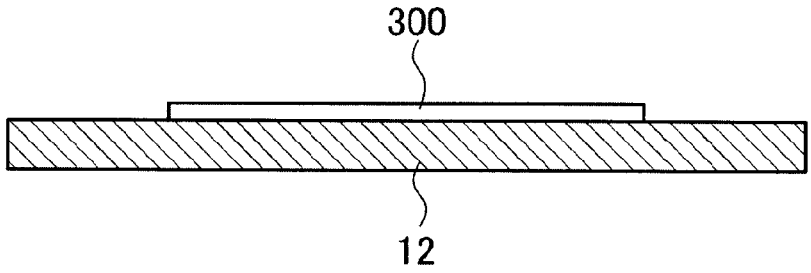
FIG. 12 is an illustrative diagram showing a schematic view of a one-layer color image.

FIG. 12 is an illustrative diagram showing a schematic view of a color image 300 formed by using the image forming unit 23' shown in FIG. 11.

Modification of Provisional Curing Light Source

Compositional Example 1

Figure 13:
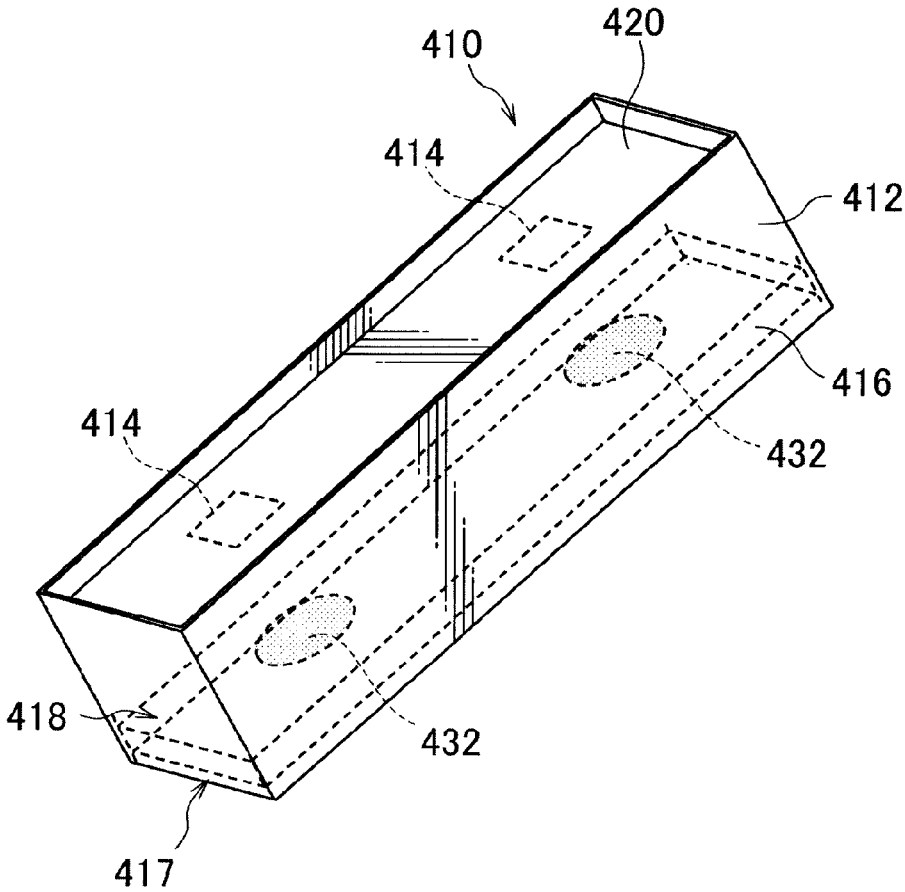
FIG. 13 is an oblique perspective diagram showing a modification of an ultraviolet light irradiation unit.

FIG. 13 is an oblique diagram showing an example of the composition (a modification) of a provisional curing light source 410. As shown in FIG. 13, the provisional curing light source 410 according to the present example has a substantially rectangular parallelepiped box shape. The provisional curing light source 410 has a structure in which ultraviolet light-emitting diode (UV-LED) elements 414 are accommodated in an aluminum housing (surround) 412 and a transmission light diffusion plate 416 is provided on the bottom face of the housing 412. The wiring substrate 420 on which the UV-LED elements 414 are mounted is arranged in the upper portion of the housing 412 in a state where the LED mounting surface is facing toward the light diffusion plate 416.

Desirably, the number of UV-LED elements 414 which are installed on the wiring substrate 420 is as small as possible, from the viewpoint of costs and the required UV irradiation width. In the present example, two UV-LED elements 414 are provided on the wiring substrate 420. In order to obtain a UV irradiation width which enables UV light to be radiated simultaneously onto the area in accordance with the whole length $L_w$ of the nozzle row 61 following the recording medium 12 conveyance direction in the inkjet head 24 shown in FIG. 3, two UV-LED elements 414 are arranged in alignment in the recording medium conveyance direction.

The length of the LED element row in which these plurality of (here, two) UV-LED elements 414 are arranged in the X direction (the width of the LED element row) $L_u$ is shorter than the whole length $L_w$ of the nozzle row 16 of the inkjet head 24 ($L_u<L_w$).

A metal substrate having enhanced heat radiating properties and thermal resistance is used for the wiring substrate 420. The detailed structure of the metal substrate is not illustrated, but the insulating layer is formed on a metal plate made of aluminum or copper, or the like, and UV-LED elements 414 and wiring circuits for driving the LEDs (anode wires, cathode wires), and the like, are formed on top of the insulating layer. It is also possible to use a metal base substrate having a circuit formed on a base metal, or a metal core substrate in which a metal plate is embedded inside a substrate.

Furthermore, a white resist which is resistant to UV light and has high reflectivity is provided about the periphery of the UV-LED elements 414 on the LED mounting surface of the wiring substrate 420. By means of this white resist layer (not illustrated), it is possible to reflect and scatter ultraviolet light on the surface of the wiring substrate 420, and hence the light emitted from the UV-LED elements 414 can be used very efficiently for UV irradiation for the purpose of provisional curing.

The light diffusion plate 416 is a milk-white colored plate which is made from an optical material that transmits and diffuses light emitted from the UV-LED elements 414. For example, the light diffusion plate 416 employs a white acrylic plate in which a white pigment (light scattering material) is dispersed.

The light diffusion plate is not limited to a white acrylic plate, and it is also possible to use an optical member formed by mixing and dispersing fine particles for light diffusion in a transparent material, such as glass. Optical diffusion plates having different transmissivity and diffusion characteristics are obtained by varying the content of light diffusing material (white pigment, etc.)

The transmission light diffusion plate which diffuses the light is not limited to a plate in which a silica powder is dispersed in an acrylic resin, and can also be achieved easily by applying a frosting treatment, a clouded glass treatment, or a ground glass treatment to the surface of a substrate made from molten quartz.

Figure 14:
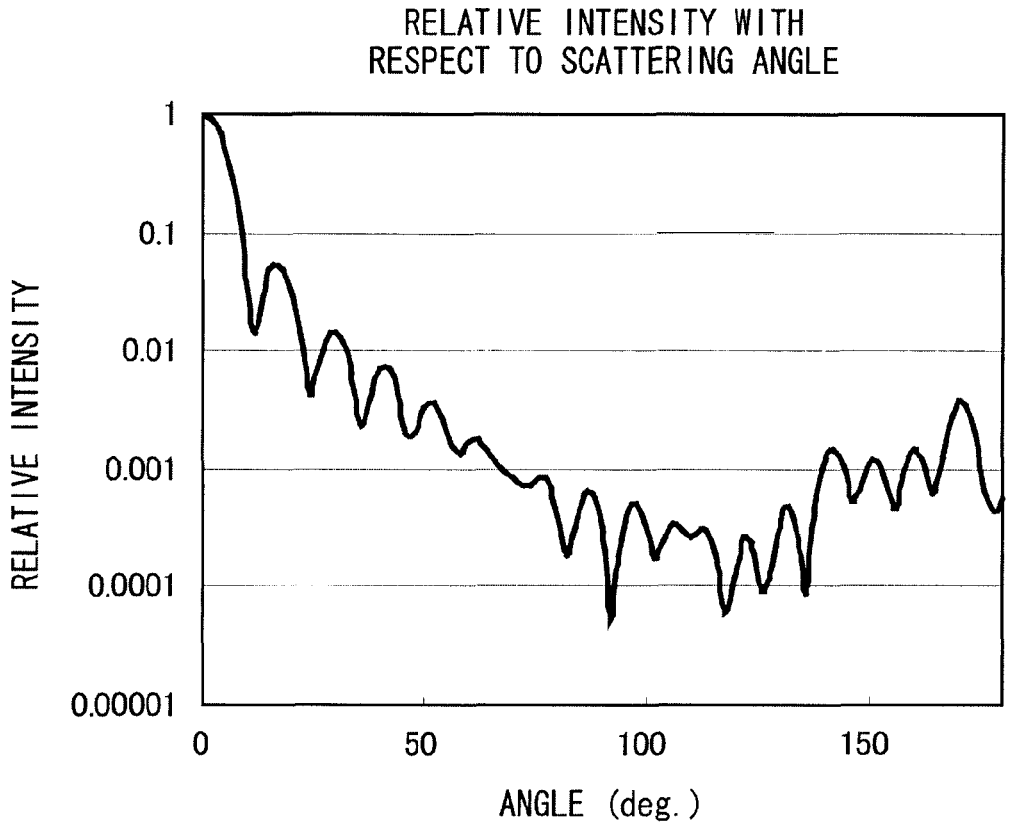
FIG. 14 is a graph showing the Mie scattering characteristics of a light diffusion plate.

The light diffusion plate 416 having diffusion properties as shown in FIG. 14 is arranged in the lower part of the housing 412, so as to oppose the LED mounting surface of the wiring substrate 420. In FIG. 13, the lower surface of the light diffusion plate 416 is a light emission surface 417 which opposes the recording medium. The light diffused by the light diffusion plate 416 is irradiated from the light emission surface 417 onto the recording medium through a light irradiation width equal to or greater than the nozzle row width $L_w$ of the inkjet head 24.

The upper surface of the light diffusion plate 416, in other words, the surface opposite to the light emission surface 417 of the light diffusion plate 416 (the surface opposing the UV-LED elements 414) is the light input surface 418 via which the light entering the light diffusion plate 416. Mirrors 432 (reflecting section) for reflecting and scattering the direct incident light of the UV-LED elements 414 are layered onto the light input surface 418 of the light diffusion plate 416, at positions opposing the respective UV-LED elements 414.

The UV-LED elements 414 and the mirrors 432 are arranged in corresponding positions so as to face each other inside the housing 412.

The housing 412 of the provisional curing light source 410 is composed from plate metal of aluminum (untreated), and the inner circumferential surface of the housing 412 functions as a side face reflecting plate. A polishing treatment or white coating, or the like, to raise the reflectivity may be provided on the inner circumferential surface of the housing 412.

According to the provisional curing light source 410 having a composition of this kind, light emitted from the UV-LED elements 414 is reflected and scattered by the mirrors 432 on the light diffusion plate 416 and reflected and scattered by the mirrors 432, the inner circumferential surface (side face reflecting plate) of the housing 412 and the white resist layer of the wiring substrate 420, and the like, and enters into the light diffusion plate 416.

The light which has entered from the light input surface 418 of the light diffusion plate 416 is diffused upon passing through the light diffusion plate 416 and is irradiated from the light emission surface 417 toward the recording medium.

Figure 15:
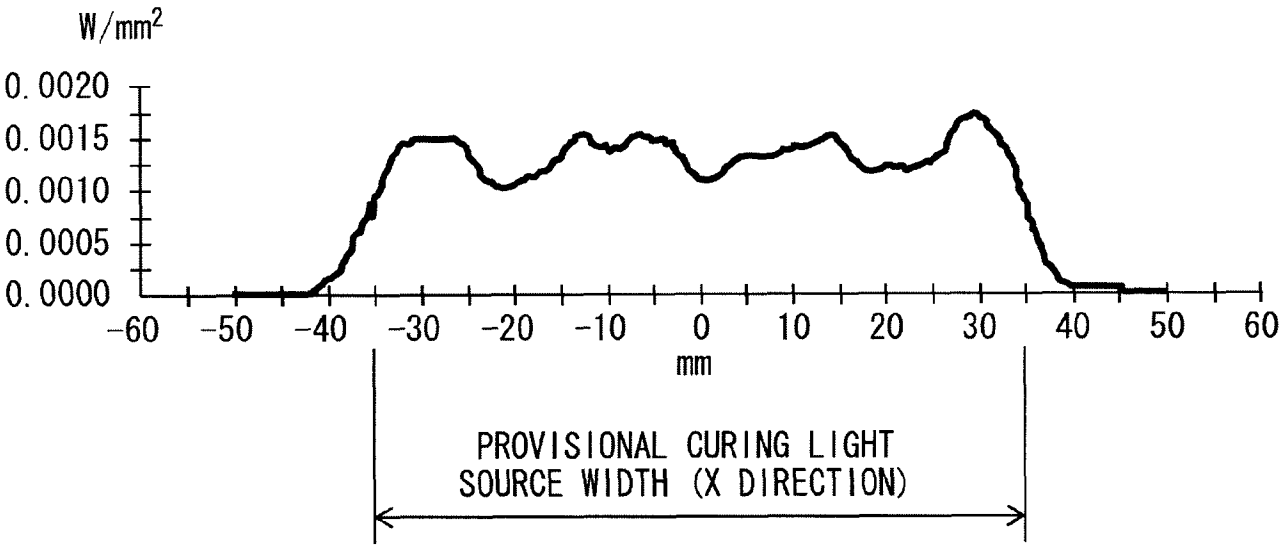
FIG. 15 is a graph showing the brightness distribution (X direction) of ultraviolet light irradiated from a provisional curing light source.
Figure 16:
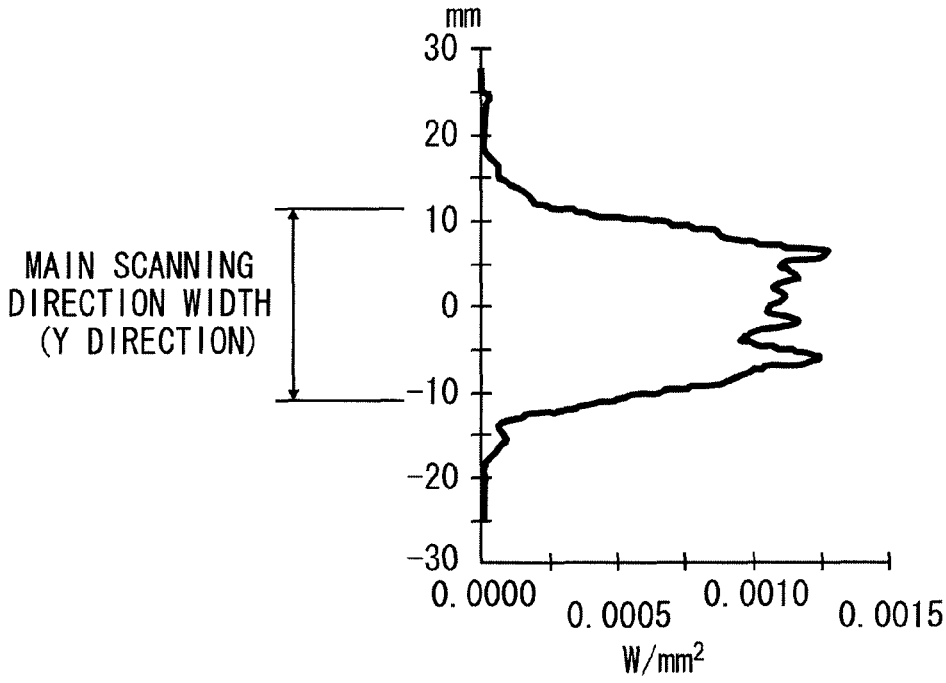
FIG. 16 is a graph showing the brightness distribution (Y direction) of ultraviolet light irradiated from a provisional curing light source.

FIG. 15 and FIG. 16 are graphs showing the illumination distribution of ultraviolet light irradiated from the provisional curing light source 410. FIG. 15 shows the illumination distribution in the X direction on the recording medium, and FIG. 16 shows the illumination distribution in the Y direction on the recording medium.

The light emission surface 417 of the provisional curing light source 410 relating to the present embodiment has an X-direction width of approximately 70 mm and a Y-direction width of approximately 12 mm. As shown in FIG. 15 and FIG. 16, the light which has passed through the light diffusion plate 416 is diffused into a substantially uniform illumination distribution and irradiated in this state.

According to the provisional curing light source 410 of the present example, a light irradiation width of a length equal to or greater than the total length $L_w$ of the nozzle row 61 is achieved even by using a composition which employs a small number of (here, two) UV-LED elements 414 ($L_u<L_w$).

According to the present embodiment, it is possible efficiently to produce an irradiance distribution having a light irradiation width equal to or greater than the nozzle row which is suitable for provisional curing, by using a small number of UV-LED elements.

Swath Width by Singling Scan

In the image formation mode of a wide-format machine, the image formation conditions for singling (interlacing) are determined respectively for different resolution settings.

More specifically, since image formation by singling is carried out by dividing the width $L_w$ of the ejection nozzle row of the inkjet head by the number of passes (number of scanning repetitions), then the swath width varies with the nozzle row width of the inkjet head and the number of passes in the main scanning direction and the sub-scanning direction (the number of interlaced divisions).

The details of singling image formation based on a multi-pass method are described in Japanese Patent Application Publication No. 2004-306617, for example.

For instance, the relationship between the number of passes and the swath width in singling image formation when using a QS-10 head manufactured by FUJIFILM Dimatix Inc. is as shown in Table 1 below. The envisaged swath width in the image formation is a value obtained by dividing the width of the nozzle row used by the product of the number of passes in the main scanning direction and the number of passes in the sub-scanning direction.

TABLE 1

| | Width of nozzle row used (mm) | | | |
|---|---|---|---|---|
| | 64.8 | 64.8 | 64.8 | 64.8 |
| Number of passes in main scanning direction | 1 | 1 | 2 | 2 |
| Number of passes in sub-scanning direction | 2 | 4 | 2 | 4 |
| Swath width (mm) | 32.4 | 16.2 | 16.2 | 8.1 |

Compositional Example 2

As described previously, in the case of a printing method in which ultraviolet light exposure is carried out while ejecting droplets from nozzle rows in a singling scanning operation, one swath includes ink droplets which have received a large number of cumulative exposures and inks droplets which have received a small number of cumulative exposures. From the viewpoint of improving fluctuation in the total amount of exposure due to differences in the number of exposures, it is desirable to modify the irradiation distribution of the provisional curing light source so as to apply an illumination distribution in the medium conveyance direction whereby the illumination intensity increases toward the downstream side of the nozzle rows.

Figure 17:
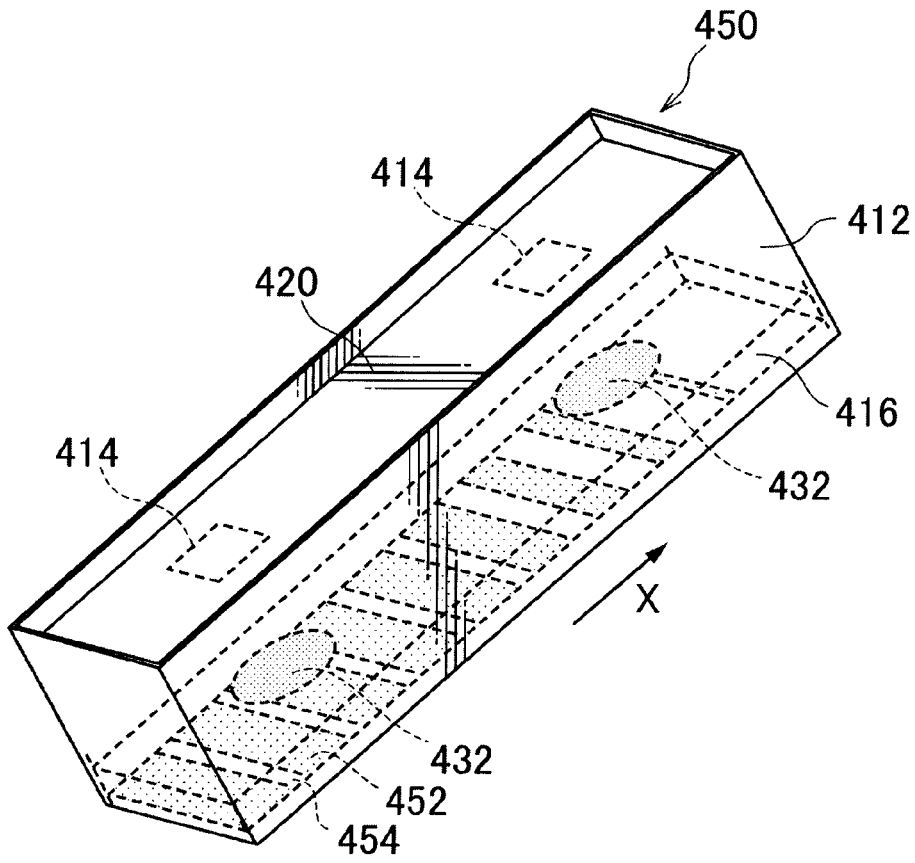
FIG. 17 is a perspective diagram showing another example of the composition of a provisional curing light source.

FIG. 17 is an example of the composition of a provisional curing light source 450 which achieves an illumination distribution of this kind. In FIG. 17, elements which are the same as or similar to the provisional curing light source 410 described above are labeled with the same reference numerals and further explanation thereof is omitted here.

In the provisional curing light source 450 shown in FIG. 17, band-shaped reflecting sections (reflective mirror) 452 are formed by a mirror coating on the light emission surface 417 of the light diffusion plate 416. The bands of the reflective mirror 452 are arranged in such a manner that the illumination intensity becomes greater, the further the position toward the downstream side in terms of the medium conveyance direction.

The bands of the reflective mirrors 452 gradually become wider (in terms of X-direction width) toward the upstream side in the medium conveyance direction and gradually become narrower toward the downstream side. The portions corresponding to the reflective mirrors 452 do not transmit light and light is irradiated from the portions (indicated by reference numeral 454) where the reflective mirrors 452 are not present.

More specifically, the light which reaches the portion of a reflective mirror 452, of the light arriving at the light emission surface 417 of the light diffusion plate 416, is reflected by the reflective mirror 452 and returns through the light diffusion plate 416. On the other hand, the light which arrives at the portions where the reflective mirrors 452 are not present (the light transmission portions 454 between the bands of the reflective mirror 452), of the light which arrives at the light emission surface 417 of the light diffusion plate 416, exits to the exterior of the light diffusion plate 416 via the light transmission portions 454.

The change in the width of the bands of the reflective mirror 452 on the light emission surface 417 of the light diffusion plate 416 is designed on the basis of a polynomial expression, so as to obtain a desired illumination distribution. The width of the light transmission portions 454 (X-direction width) where the reflective mirrors 452 are not layered becomes broader toward the downstream side of the medium conveyance direction, and an illumination distribution is achieved in which the illumination intensity becomes greater toward to the downstream side.

Figure 18:
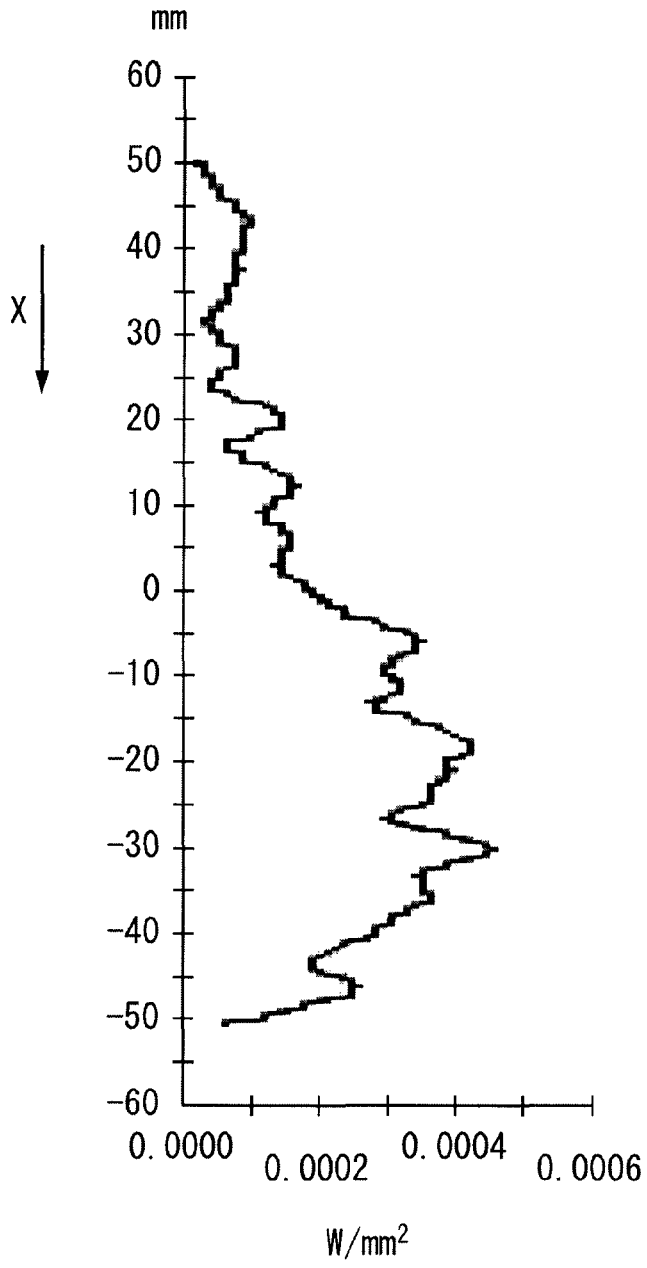
FIG. 18 is a graph showing a brightness distribution (X direction) of a provisional curing light source described in FIG. 17.
Figure 19:
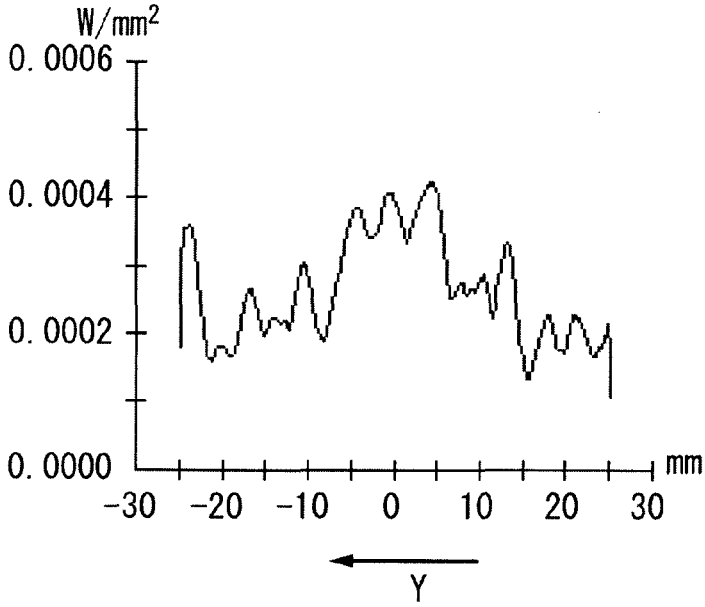
FIG. 19 is a graph showing a brightness distribution (Y direction) of a provisional curing light source described in FIG. 17.

FIG. 18 is a graph showing the illumination distribution, in the conveyance direction (X direction) of the recording medium 12, of the provisional curing light source 450 shown in FIG. 17, and FIG. 19 shows a cross-section of the illumination distribution in the scanning direction of the image forming unit 23 (in the Y direction). These show a distribution on the center lines of the irradiation area on the medium surface (the center line in the Y-direction and the center line in the X-direction). As shown in FIG. 18, a distribution is obtained in which the illumination intensity increases toward the downstream side in the medium conveyance direction.

In order to enable adjustment of the amount of light and the illumination distribution of the provisional curing light source in this way, a composition is adopted in which the light diffusion plate 416 of the provisional curing light source is replaceable. Light diffusion plates 416 of a plurality of types having different diffuse transmittance and different distributions of the reflective mirrors 452 in the light emission surface 417 are prepared in advance, and the light diffusion plate 416 is changed in accordance with the recording medium used and the image formation mode.

For example, a light diffusion plate having a lower transmission is used, the higher the surface reflectivity of the recording medium used. Furthermore, a light diffusion plate having a distribution of the reflective mirror 452 which achieves a suitable illumination intensity distribution is prepared in advance for each image formation mode, and an operator (printer user) carries out a task of changing to a corresponding light diffusion plate, in accordance with the image formation mode for printing.

In order to facilitate the task of changing the light diffusion plate 416, an installation structure for installing the light diffusion plate 416 removably is provided in the lower part of the housing 412. More specifically, for example, grooves for supporting the edges of a light diffusion plate 416 are formed in a light diffusion plate installation section of the housing 412, and a light diffusion plate 416 is set in place by inserting the light diffusion plate 416 along the grooves.

When replacing a light diffusion plate 416, the light diffusion plate 416 set in position is pulled out and another light diffusion plate is inserted. The installation structure is not limited to a pull-out system of this kind, and it is also possible to employ various installation structures, such as a structure where plates are installed and removed by using the engagement of a hook, or a structure where plates are installed and removed by using the interlocking of projections and recesses.

Furthermore, it is also possible to adopt a composition in which the provisional curing light source including the light diffusion plate is changed, rather than changing the light diffusion plate only. In this case, provisional curing light sources of a plurality of types corresponding to the recording media used and the image formation modes are prepared in advance, and an operator (printer user) carries out a task of changing to a corresponding provisional curing light source in accordance with the type of recording medium used or the image formation mode during printing.

By replacing the light diffusion plate or the provisional curing light source including the light diffusion plate, the light amount distribution for provisional curing is adjusted and it is possible to irradiate ultraviolet light of a high amount, only onto an ejection region of slow-curing ink which has low sensitivity with respect to ultraviolet light.

In the present embodiment, an example is given in which the ultraviolet light is used as an active light beam for curing ink, but it is also possible to use a light beam having a wavelength band other than ultraviolet light as the active light beam. More specifically, the active light beam which cures ink can employ a light beam of a wavelength band which is capable of irradiating the energy required to cure ink. Furthermore, it is also possible to use active light beams having different wavelength bands in the main curing light sources and the provisional curing light sources respectively.

For example, the provisional curing light sources can employ light sources which irradiate an amount of energy for curing the ink to the extent of suppressing movement of the ink and which generate lower active energy than the main curing light source. On the other hand, the main curing light source employs a light beam capable of generating an active energy which is higher than the provisional curing light source.

Inkjet recording apparatuses and image forming methods to which the present invention are applied have been described in detail above, but suitable modifications are possible in a range which does not depart from the essence of the present invention.

APPENDIX

As has become evident from the detailed description of the embodiments given above, the present specification includes disclosure of various technical ideas including the aspects of the invention described below.

Mode 1

One aspect of the invention is directed to an inkjet recording apparatus comprising: an image forming device including a nozzle row having a plurality of nozzles for ejecting ink onto a recording medium, the ink being to be curable by irradiation of an active light beam, the nozzle row being divided into a plurality of nozzle groups; a scanning device which causes the image forming device to move in a scanning direction perpendicular to a nozzle arrangement direction in which the plurality of nozzles of the nozzle row are arranged; a relative movement device which causes relative movement between the recording medium and the image forming device in the nozzle arrangement direction; a first active light beam irradiation device which is provided to a downstream side of the image forming device in terms of the scanning direction, is divided into a plurality of irradiation units corresponding to the plurality of nozzle groups, and radiates an active light beam onto the ink on the recording medium so as to provisionally cure the ink while moving in the scanning direction together with the image forming device; a second active light beam irradiation device which is provided to a downstream side of the image forming device in terms of a direction of the relative movement, and radiates an active light beam having an irradiation light quantity for fully curing the ink deposited on the recording medium in such a manner that the ink on the recording medium is fully cured; an ejection control device which controls ink ejection from the nozzle row, for each of the plurality of nozzle groups; and an irradiation control device which controls irradiation of the active light beam of the first active light beam irradiation device, with respect to each of the plurality of irradiation units, according to an irradiation light quantity of the active light beam of the first active light beam irradiation device which is set with respect to each of the plurality of irradiation units.

According to this mode of the present invention, since the nozzle row in which a plurality of nozzles for ejecting ink are arranged is divided in the relative movement direction of the recording medium and the image forming device (nozzle row), the first active light beam irradiation device which provisionally cures the ink by irradiating an active light beam onto the ink which has been ejected from the nozzle row and deposited onto the recording medium is divided in accordance with the nozzle row, and the irradiated light quantity of the active light beam is set for each irradiation unit which is a divided unit of the first active light beam irradiation device, then the ink which has been ejected from a particular nozzle group is provisionally cured by the active light beam irradiated from an irradiation unit following the nozzle group and a provisionally cured state of the ink corresponding to the irradiated light quantity of the irradiation unit is obtained. Consequently, it is possible to control the provisionally cured state of the ink with respect to each irradiation unit (nozzle group), and the glossiness reproduction range of the image can be expanded in accordance with the provisionally cured state of the ink.

An ultraviolet light beam is one example of the "active light beam" in the present invention.

"A provisionally cured state" in the present invention is a state where the ink droplets are cured to an extent in which movement of the ink on the recording medium is prevented.

Mode 2

Desirably, the nozzle row is divided in the direction of the relative movement to include a first nozzle group on an upstream side in the direction of the relative movement and a second nozzle group on a downstream side in the direction of the relative movement; the first active light beam irradiation device is divided in the direction of the relative movement to include a first irradiation unit on the upstream side in the direction of the relative movement and a second irradiation unit on the downstream side in the direction of the relative movement; and the irradiation control device controls the irradiation light quantity of the first irradiation unit so as to provisionally cure the ink ejected from the first nozzle group to a state in which landing interference of the ink is prevented and the ink does not spread to a prescribed size in such a manner that the ink ejected from the first nozzle group forms a matt texture, and controls the irradiation light quantity of the second irradiation unit so as to provisionally cure the ink ejected from the second nozzle group to a state in which landing interference of the ink is prevented and the ink spreads to a prescribed size in such a manner that the ink ejected from the second nozzle group forms a gloss texture.

According to this mode, it is possible to form a matt texture and a gloss texture having different glossiness, within the same image. Furthermore, by setting the irradiated light quantity of the first irradiation unit (on the upstream side) to a high light quantity, and setting the irradiated light quantity of the second irradiation unit (on the downstream side) to a low light quantity, it is possible to avoid landing interference at swath edges which occur on the upstream side of an inkjet head during formation of color images, and therefore banding can be reduced.

Mode 3

Desirably, the image forming device includes a color ink nozzle row which ejects color ink.

According to this mode, it is possible to form a color image which contains a plurality of images (regions) having different glossiness.

In this mode, examples of "color inks" are inks containing yellow, magenta, cyan and black coloring materials. Furthermore, examples of "color inks" may be light inks having lower density than standard colors, such as light magenta, light cyan, and the like.

Mode 4

Desirably, the first active light beam irradiation device is divided in the direction of the relative movement to include a first irradiation unit on an upstream side in the direction of the relative movement and a second irradiation unit on a downstream side in the direction of the relative movement; and the irradiation control device sets the irradiation light quantity of the first irradiation unit and the irradiation light quantity of the second irradiation unit in such a manner that the irradiation light quantity of the second irradiation unit is not less than twice and not greater than five times the irradiation light quantity of the first irradiation unit.

In this mode, it is possible to set the irradiated light quantity of the first irradiation unit to not less than 2 $mJ/cm^2$ and not more than 4 $mJ/cm^2$. Furthermore, it is possible to set the irradiated light quantity of the second irradiation unit to not less than 8 $mJ/cm^2$ and not more than 10 $mJ/cm^2$.

Mode 5

Desirably, the irradiation control device switches off the second irradiation unit.

According to this mode, it is possible to form a high-gloss texture by not irradiating an active light beam from the second irradiation unit.

Mode 6

Desirably, the image forming device includes a color ink nozzle row which ejects color ink and a clear ink nozzle row which ejects clear ink, and the color ink nozzle row and the clear ink nozzle row are arranged in the scanning direction and are divided in terms of the direction of the relative movement to include a first nozzle group on a furthest upstream side in the direction of the relative movement, a second nozzle group to a downstream side of the first nozzle group in the direction of the relative movement, and a third nozzle group to a downstream side of the second nozzle group in the direction of the relative movement; the first active light beam irradiation device is divided in terms of the direction of the relative movement to include a first irradiation unit, a second irradiation unit and a third irradiation unit corresponding to the first nozzle group, the second nozzle group and the third nozzle group of the color ink nozzle row and the clear ink nozzle row; the ejection control device controls the ink ejection so as to eject the color ink from the first nozzle group of the color ink nozzle row and so as to eject the clear ink from the second nozzle group and the third nozzle group of the clear ink nozzle row; and the irradiation control device controls the irradiation light quantity of the second irradiation unit so as to provisionally cure the clear ink ejected from the second nozzle group of the clear ink nozzle row to a state in which landing interference of the clear ink is prevented and the clear ink does not spread to a prescribed size in such a manner that the clear ink ejected from the second nozzle group forms a matt texture, and controls the irradiation light quantity of the third irradiation unit so as to provisionally cure the clear ink ejected from the third nozzle group of the clear ink nozzle row to a state in which landing interference of the clear ink is prevented and the clear ink spreads to a prescribed size in such a manner that the clear ink ejected from the third nozzle group forms a gloss texture.

According to this mode, it is possible to form a matt texture having low glossiness and a gloss texture having high glossiness, by altering the provisionally cured state of the clear ink layer through changing the irradiated light quantity of the active light beam which is irradiated onto the clear ink.

In this mode, the "clear ink" may be a transparent ink containing no coloring material, or an ink containing a small amount of coloring material of a level whereby the color is not visible.

Mode 7

Desirably, a length of the first nozzle group of the color ink nozzle row in the direction of the relative movement is one third of a total length of the color ink nozzle row; and a length of the first nozzle group, a length of the second nozzle group and a length of the third nozzle group of the clear ink nozzle row, in the direction of the relative movement, are one third of a total length of the clear ink nozzle row.

Mode 8

Desirably, the ejection control device controls the ink ejection from the color ink nozzle row and the ink ejection from the clear ink nozzle row in such a manner that a clear ink layer formed of the clear ink ejected from the clear ink nozzle row is layered onto a color image layer formed of the color ink ejected from the color ink nozzle row.

According to this mode, since a clear ink layer is formed by the clear ink on top of the color image layer created by color inks, then it is possible to form a color image having a combination of regions of different glossiness, by altering the provisionally cured state of the clear ink only.

Mode 9

Desirably, the irradiation control device sets the irradiation light quantity of the second irradiation unit and the irradiation light quantity of the third irradiation unit in such a manner that the irradiation light quantity of the third irradiation unit is not less than twice and not greater than five times the irradiation light quantity of the second irradiation unit.

Mode 10

Desirably, the irradiation control device switches off the third irradiation unit.

Mode 11

Desirably, the relative movement device moves the recording medium and the image forming device relatively in one direction.

According to this mode, it is possible to form a clear ink layer on the color image layer by relatively moving the recording medium and the image forming device in one direction only, and therefore positional displacement of the color image layer and the clear ink layer can be prevented and conveyance abnormalities of the recording medium can be avoided.

Mode 12

Desirably, the image forming device includes a color ink nozzle row which ejects color ink and a clear ink nozzle row which ejects clear ink, and the clear ink nozzle row is divided in terms of the direction of the relative movement to include a first nozzle group on an upstream side in the direction of the relative movement and a second nozzle group on a downstream side in the direction of the relative movement; the first active light beam irradiation device is divided in terms of the direction of the relative movement to include a first irradiation unit and a second irradiation unit corresponding to the first nozzle group and the second nozzle group of the clear ink nozzle row; the relative movement device returns the recording medium to an ejection start position of the clear ink nozzle row after the color ink is ejected onto the recording medium from the color ink nozzle row, and then moves the recording medium in the direction of the relative movement; the ejection control device controls the ink ejection so as to cause the color ink to be ejected onto the recording medium from the color ink nozzle row, and then cause the clear ink to be ejected onto the recording medium that is being moved in the direction of the relative movement after the recording medium is returned to the ejection start position of the clear ink nozzle row by the relative movement device; and the irradiation control device controls the irradiation light quantity of the first irradiation unit so as to provisionally cure the clear ink ejected from the first nozzle group of the clear ink nozzle row to a state in which landing interference of the clear ink is prevented and the clear ink does not spread to a prescribed size in such a manner that the clear ink ejected from the first nozzle group forms a matt texture, and controls the irradiation light quantity of the second irradiation unit so as to provisionally cure the clear ink ejected from the second nozzle group of the clear ink nozzle row to a state in which landing interference of the clear ink is prevented and the clear ink spreads to a prescribed size in such a manner that the clear ink ejected from the second nozzle group forms a gloss texture.

Mode 13

Desirably, the irradiation control device sets the irradiation light quantity of the first irradiation unit and the irradiation light quantity of the second irradiation unit in such a manner that the irradiation light quantity of the second irradiation unit is not less than twice and not greater than five times the irradiation light quantity of the first irradiation unit.

Mode 14

Desirably, the irradiation control device switches off the second irradiation unit.

Mode 15

Desirably, the irradiation control device sets the irradiation light quantity of the second active light beam irradiation device in such a manner that the irradiation light quantity of the second active light beam irradiation device is not less than 15 times and not greater than 150 times the irradiation light quantity of the first active light beam irradiation device.

In this mode, it is possible to set the irradiated light quantity of the second active light beam irradiation device to not less than 150 mJ/cm$^2$ and not more than 300 mJ/cm$^2$.

Mode 16

Desirably, the irradiation control device performs any one of electric current control, pulse width modulation control and on/off control to vary the irradiation light quantity of the active light beam radiated from the first active light beam irradiation device and the second active light beam irradiation device.

According to this mode, it is possible to control light emission of the ultraviolet LED elements individually, and an optimal active light beam can be irradiated onto the ejection positions of the respective inks, in accordance with the ink curing characteristics.

Mode 17

Desirably, the first active light beam irradiation device has a structure in which a plurality of ultraviolet LED elements are arranged in a direction parallel to the direction of the relative movement in accordance with divided units of the nozzle row.

In this case, it is possible to adopt a mode in which a plurality of element rows are arranged in the scanning direction, each element row having a plurality of ultraviolet LED elements aligned in a direction parallel to the relative movement direction.

Mode 18

Desirably, each of the plurality of irradiation units of the first active light beam irradiation device has a length of not greater than a value obtained by dividing a total length of the nozzle row in a direction parallel to the direction of the relative movement by number of the plurality of nozzle groups included in the nozzle row.

According to this mode, irradiation of an active light beam onto unwanted regions is prevented.

In this mode, if the total length of the nozzle row in the relative conveyance direction is represented as $L_w$ and if the number of divisions of the nozzle row is N, then the irradiation range of the first active light beam irradiation device in the relative conveyance direction is not greater than $L_w/N$.

Mode 19

Desirably, the image forming device includes the plurality of nozzle rows; the ink ejected from the plurality of nozzles forms dots on the recording medium; and the relative movement device causes the relative movement between the image forming device and the recording medium intermittently in one direction, by setting an amount of conveyance in one relative movement action to a length obtained by dividing a length in the direction of the relative movement of each of the plurality of nozzle groups included in the plurality of nozzle rows by number of multiple passes, the number of the multiple passes being defined as product of a value obtained by dividing an arrangement pitch of the plurality of nozzle rows in the scanning direction by a minimum pitch of the dots in the scanning direction, and a value obtained by dividing an arrangement pitch of the plurality of nozzles in the direction of the relative movement by a minimum pitch of the dots in the direction of the relative movement.

According to this mode, it is possible to form an image in which a plurality of layers are superimposed on each other, without the recording medium and the image forming device performing a reciprocal movement.

Mode 20

Desirably, the image forming device includes an inkjet head having the nozzle rows corresponding to a plurality of inks.

Mode 21

Desirably, the image forming device includes an inkjet head having the nozzle row, for each ink Mode 22

Another mode of the invention is directed to an image forming method comprising the steps of: causing an image forming device having a nozzle row in which a plurality of nozzles for ejecting ink towards a recording medium are arranged in a nozzle arrangement direction and which is divided into a plurality of nozzle groups, to eject the ink from each of the plurality of nozzle groups of the nozzle row, while causing the image forming device to move in a scanning direction perpendicular to the nozzle arrangement direction of the nozzle row, the ink being curable by irradiation of an active light beam; causing relative movement between the recording medium and the image forming device in the nozzle arrangement direction; radiating an active light beam onto the ink from a first active light beam irradiation device which is provided to a downstream side of the image forming device in the scanning direction and is divided into a plurality of irradiation units corresponding to the plurality of nozzle groups in such a manner that the ink on the recording medium is provisionally cured, while moving the first active light beam irradiation device in the scanning direction together with the image forming device; and radiating an active light beam having an irradiation light quantity for fully curing the ink deposited on the recording medium from a second active light beam irradiation device which is provided to a downstream side of the image forming device in a direction of the relative movement in such a manner that the ink on the recording medium is fully cured, wherein in the step of provisionally curing the ink on the recording medium, radiation of the active light beam from the first active light beam irradiation device is controlled, for each of the plurality of irradiation units, according to an irradiation light quantity of the active light beam of the first active light beam irradiation device which is set for each of the plurality of irradiation units.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus comprising:

an image forming device including a nozzle row having a plurality of nozzles for ejecting ink onto a recording medium, the ink being curable by irradiation of an active light beam, the nozzle row being divided into a plurality of nozzle groups;

a scanning device which causes the image forming device to move in a scanning direction perpendicular to a nozzle arrangement direction in which the plurality of nozzles of the nozzle row are arranged;

a relative movement device which causes relative movement between the recording medium and the image forming device in the nozzle arrangement direction;

a first active light beam irradiation device which is provided to one side or both sides of the image forming device in terms of the scanning direction, is divided into a plurality of irradiation units corresponding to the plurality of nozzle groups, and radiates an active light beam onto the ink on the recording medium so as to provisionally cure the ink while moving in the scanning direction together with the image forming device;

a second active light beam irradiation device which is provided to a downstream side of the image forming device in terms of a direction of the relative movement, and radiates an active light beam having an irradiation light quantity for fully curing the ink deposited on the recording medium in such a manner that the ink on the recording medium is fully cured;

an ejection control device which controls ink ejection from the nozzle row, for each of the plurality of nozzle groups; and an irradiation control device which controls irradiation of the active light beam of the first active light beam irradiation device, with respect to each of the plurality of irradiation units, according to an irradiation light quantity of the active light beam of the first active light beam irradiation device which is set with respect to each of the plurality of irradiation units, wherein:

the image forming device includes a color ink nozzle row which ejects color ink and a clear ink nozzle row which ejects clear ink, and the color ink nozzle row and the clear ink nozzle row are arranged in the scanning direction and are divided in terms of the direction of the relative movement to include a first nozzle group on a furthest upstream side in the direction of the relative movement, a second nozzle group to a downstream side of the first nozzle group in the direction of the relative movement, and a third nozzle group to a downstream side of the second nozzle group in the direction of the relative movement;

the first active light beam irradiation device is divided in terms of the direction of the relative movement to include a first irradiation unit, a second irradiation unit and a third irradiation unit corresponding to the first nozzle group, the second nozzle group and the third nozzle group of the color ink nozzle row and the clear ink nozzle row;

the ejection control device controls the ink ejection so as to eject the color ink from the first nozzle group of the color ink nozzle row and so as to eject the clear ink from the second nozzle group and the third nozzle group of the clear ink nozzle row; and the irradiation control device controls the irradiation light quantity of the second irradiation unit so as to provisionally cure the clear ink ejected from the second nozzle group of the clear ink nozzle row to a state in which landing interference of the clear ink is prevented and the clear ink does not spread to a prescribed size in such a manner that the clear ink ejected from the second nozzle group forms a matt texture, and controls the irradiation light quantity of the third irradiation unit so as to provisionally cure the clear ink ejected from the third nozzle group of the clear ink nozzle row to a state in which landing interference of the clear ink is prevented and the clear ink spreads to a prescribed size in such a manner that the clear ink ejected from the third nozzle group forms a gloss texture, wherein:

the irradiation light quantity of the second irradiation unit is greater than the irradiation light quantity of the third irradiation unit, the second nozzle group and the third nozzle group in the same nozzle row eject ink of the same type.

2. The inkjet recording apparatus as defined in claim 1, wherein a length of the first nozzle group of the color ink nozzle row in the direction of the relative movement is one third of a total length of the color ink nozzle row; and a length of the first nozzle group, a length of the second nozzle group and a length of the third nozzle group of the clear ink nozzle row, in the direction of the relative movement, are one third of a total length of the clear ink nozzle row.

3. The inkjet recording apparatus as defined in claim 1, wherein the ejection control device controls the ink ejection from the color ink nozzle row and the ink ejection from the clear ink nozzle row in such a manner that a clear ink layer formed of the clear ink ejected from the clear ink nozzle row is layered onto a color image layer formed of the color ink ejected from the color ink nozzle row.

4. The inkjet recording apparatus as defined in claim 1, wherein the irradiation control device sets the irradiation light quantity of the second irradiation unit and the irradiation light quantity of the third irradiation unit in such a manner that the irradiation light quantity of the second irradiation unit is not less than twice and not greater than five times the irradiation light quantity of the third irradiation unit.

5. The inkjet recording apparatus as defined in claim 1, wherein the irradiation control device switches off the third irradiation unit.

6. An inkjet recording apparatus comprising:

an image forming device including a nozzle row having a plurality of nozzles for ejecting ink onto a recording medium, the ink being curable by irradiation of an active light beam, the nozzle row being divided into a plurality of nozzle groups;

a scanning device which causes the image forming device to move in a scanning direction perpendicular to a nozzle arrangement direction in which the plurality of nozzles of the nozzle row are arranged;

a relative movement device which causes relative movement between the recording medium and the image forming device in the nozzle arrangement direction;

a first active light beam irradiation device which is provided to one side or both sides of the image forming device in terms of the scanning direction, is divided into a plurality of irradiation units corresponding to the plurality of nozzle groups, and radiates an active light beam onto the ink on the recording medium so as to provisionally cure the ink while moving in the scanning direction together with the image forming device;

a second active light beam irradiation device which is provided to a downstream side of the image forming device in terms of a direction of the relative movement, and radiates an active light beam having an irradiation light quantity for fully curing the ink deposited on the recording medium in such a manner that the ink on the recording medium is fully cured;

an ejection control device which controls ink ejection from the nozzle row, for each of the plurality of nozzle groups; and an irradiation control device which controls irradiation of the active light beam of the first active light beam irradiation device, with respect to each of the plurality of irradiation units, according to an irradiation light quantity of the active light beam of the first active light beam irradiation device which is set with respect to each of the plurality of irradiation units, wherein:

the image forming device includes a color ink nozzle row which ejects color ink and a clear ink nozzle row which ejects clear ink, and the clear ink nozzle row is divided in terms of the direction of the relative movement to include a first nozzle group on an upstream side in the direction of the relative movement and a second nozzle group on a downstream side in the direction of the relative movement;

the first active light beam irradiation device is divided in terms of the direction of the relative movement to include a first irradiation unit and a second irradiation unit corresponding to the first nozzle group and the second nozzle group of the clear ink nozzle row;

the relative movement device returns the recording medium to an ejection start position of the clear ink nozzle row after the color ink is ejected onto the recording medium from the color ink nozzle row, and then moves the recording medium in the direction of the relative movement;

the ejection control device controls the ink ejection so as to cause the color ink to be ejected onto the recording medium from the color ink nozzle row, and then cause the clear ink to be ejected onto the recording medium that is being moved in the direction of the relative movement after the recording medium is returned to the ejection start position of the clear ink nozzle row by the relative movement device; and the irradiation control device controls the irradiation light quantity of the first irradiation unit so as to provisionally cure the clear ink ejected from the first nozzle group of the clear ink nozzle row to a state in which landing interference of the clear ink is prevented and the clear ink does not spread to a prescribed size in such a manner that the clear ink ejected from the first nozzle group forms a matt texture, and controls the irradiation light quantity of the second irradiation unit so as to provisionally cure the clear ink ejected from the second nozzle group of the clear ink nozzle row to a state in which landing interference of the clear ink is prevented and the clear ink spreads to a prescribed size in such a manner that the clear ink ejected from the second nozzle group forms a gloss texture, wherein:

the irradiation light quantity of the first irradiation unit is greater than the irradiation light quantity of the second irradiation unit, the first nozzle group and the second nozzle group in the same nozzle row eject ink of the same type.

7. The inkjet recording apparatus as defined in claim 6, wherein the irradiation control device sets the irradiation light quantity of the first irradiation unit and the irradiation light quantity of the second irradiation unit in such a manner that the irradiation light quantity of the first irradiation unit is not less than twice and not greater than five times the irradiation light quantity of the second irradiation unit.

8. The inkjet recording apparatus as defined in claim 6, wherein the irradiation control device switches off the second irradiation unit.

9. An image forming method comprising the steps of:

causing an image forming device having a nozzle row in which a plurality of nozzles for ejecting ink towards a recording medium are arranged in a nozzle arrangement direction and which is divided into a plurality of nozzle groups, to eject the ink from each of the plurality of nozzle groups of the nozzle row, while causing the image forming device to move in a scanning direction perpendicular to the nozzle arrangement direction of the nozzle row, the ink being curable by irradiation of an active light beam;

causing relative movement between the recording medium and the image forming device in the nozzle arrangement direction;

radiating an active light beam onto the ink from a first active light beam irradiation device which is provided to one side or both sides of the image forming device in the scanning direction and is divided into a plurality of irradiation units corresponding to the plurality of nozzle groups in such a manner that the ink on the recording medium is provisionally cured, while moving the first active light beam irradiation device in the scanning direction together with the image forming device; and radiating an active light beam having an irradiation light quantity for fully curing the ink deposited on the recording medium from a second active light beam irradiation device which is provided to a downstream side of the image forming device in a direction of the relative movement in such a manner that the ink on the recording medium is fully cured, wherein in the step of provisionally curing the ink on the recording medium, radiation of the active light beam from the first active light beam irradiation device is controlled, for each of the plurality of irradiation units, according to an irradiation light quantity of the active light beam of the first active light beam irradiation device which is set for each of the plurality of irradiation units, wherein:

the image forming device includes a color ink nozzle row which ejects color ink and a clear ink nozzle row which ejects clear ink, and the color ink nozzle row and the clear ink nozzle row are arranged in the scanning direction and are divided in terms of the direction of the relative movement to include a first nozzle group on a furthest upstream side in the direction of the relative movement, a second nozzle group to a downstream side of the first nozzle group in the direction of the relative movement, and a third nozzle group to a downstream side of the second nozzle group in the direction of the relative movement; and the first active light beam irradiation device is divided in terms of the direction of the relative movement to include a first irradiation unit, a second irradiation unit and a third irradiation unit corresponding to the first nozzle group, the second nozzle group and the third nozzle group of the color ink nozzle row and the clear ink nozzle row, wherein in the step of provisionally curing the ink on the recording medium, the ink ejection is controlled so as to eject the color ink from the first nozzle group of the color ink nozzle row and so as to eject the clear ink from the second nozzle group and the third nozzle group of the clear ink nozzle row; and the irradiation light quantity of the second irradiation unit is controlled so as to provisionally cure the clear ink ejected from the second nozzle group of the clear ink nozzle row to a state in which landing interference of the clear ink is prevented and the clear ink does not spread to a prescribed size in such a manner that the clear ink ejected from the second nozzle group forms a matt texture, and the irradiation light quantity of the third irradiation unit is controlled so as to provisionally cure the clear ink ejected from the third nozzle group of the clear ink nozzle row to a state in which landing interference of the clear ink is prevented and the clear ink spreads to a prescribed size in such a manner that the clear ink ejected from the third nozzle group forms a gloss texture, wherein:

the irradiation light quantity of the second irradiation unit is greater than the irradiation light quantity of the third irradiation unit, the second nozzle group and the third nozzle group in the same nozzle row eject ink of the same type.

10. An image forming method comprising the steps of:

causing an image forming device having a nozzle row in which a plurality of nozzles for ejecting ink towards a recording medium are arranged in a nozzle arrangement direction and which is divided into a plurality of nozzle groups, to eject the ink from each of the plurality of nozzle groups of the nozzle row, while causing the image forming device to move in a scanning direction perpendicular to the nozzle arrangement direction of the nozzle row, the ink being curable by irradiation of an active light beam;

causing relative movement between the recording medium and the image forming device in the nozzle arrangement direction;

radiating an active light beam onto the ink from a first active light beam irradiation device which is provided to one side or both sides of the image forming device in the scanning direction and is divided into a plurality of irradiation units corresponding to the plurality of nozzle groups in such a manner that the ink on the recording medium is provisionally cured, while moving the first active light beam irradiation device in the scanning direction together with the image forming device; and radiating an active light beam having an irradiation light quantity for fully curing the ink deposited on the recording medium from a second active light beam irradiation device which is provided to a downstream side of the image forming device in a direction of the relative movement in such a manner that the ink on the recording medium is fully cured, wherein in the step of provisionally curing the ink on the recording medium, radiation of the active light beam from the first active light beam irradiation device is controlled, for each of the plurality of irradiation units, according to an irradiation light quantity of the active light beam of the first active light beam irradiation device which is set for each of the plurality of irradiation units, wherein:

the image forming device includes a color ink nozzle row which ejects color ink and a clear ink nozzle row which ejects clear ink, and the clear ink nozzle row is divided in terms of the direction of the relative movement to include a first nozzle group on an upstream side in the direction of the relative movement and a second nozzle group on a downstream side in the direction of the relative movement; and the first active light beam irradiation device is divided in terms of the direction of the relative movement to include a first irradiation unit and a second irradiation unit corresponding to the first nozzle group and the second nozzle group of the clear ink nozzle row; wherein returning the recording medium to an ejection start position of the clear ink nozzle row after the color ink is ejected onto the recording medium from the color ink nozzle row, and then moving the recording medium in the direction of the relative movement;

in the step of provisionally curing the ink on the recording medium, the ink ejection is controlled so as to cause the color ink to be ejected onto the recording medium from the color ink nozzle row, and then cause the clear ink to be ejected onto the recording medium that is being moved in the direction of the relative movement after the recording medium is returned to the ejection start position of the clear ink nozzle row by the relative movement device; and the irradiation light quantity of the first irradiation unit is controlled so as to provisionally cure the clear ink ejected from the first nozzle group of the clear ink nozzle row to a state in which landing interference of the clear ink is prevented and the clear ink does not spread to a prescribed size in such a manner that the clear ink ejected from the first nozzle group forms a matt texture, and the irradiation light quantity of the second irradiation unit is controlled so as to provisionally cure the clear ink ejected from the second nozzle group of the clear ink nozzle row to a state in which landing interference of the clear ink is prevented and the clear ink spreads to a prescribed size in such a manner that the clear ink ejected from the second nozzle group forms a gloss texture, wherein:

the irradiation light quantity of the first irradiation unit is greater than the irradiation light quantity of the second irradiation unit, the first nozzle group and the second nozzle group in the same nozzle row eject ink of the same type.

* * * * *